US009835001B2

(12) United States Patent
Watt et al.

(10) Patent No.: US 9,835,001 B2
(45) Date of Patent: Dec. 5, 2017

(54) WELL INSTRUMENTATION DEPLOYMENT PAST A DOWNHOLE TOOL FOR IN SITU HYDROCARBON RECOVERY OPERATIONS

(71) Applicants: SUNCOR ENERGY INC., Calgary (Alberta) (CA); SELECT ENERGY SYSTEMS INC., Calgary (Alberta) (CA)

(72) Inventors: Alan Watt, Calgary (CA); Brian Burdick, Calgary (CA); Kelly Jones, Calgary (CA)

(73) Assignees: SUNCOR ENERGY INC., Calgary, (Alberta) (CA); SELECT ENERGY SYSTEMS INC., Calgary (Alberta) (CA)

( * ) Notice: Subject to any disclaimer, the term of this patent is extended or adjusted under 35 U.S.C. 154(b) by 197 days.

(21) Appl. No.: 14/733,773

(22) Filed: Jun. 8, 2015

(65) Prior Publication Data

US 2015/0354302 A1 Dec. 10, 2015

(30) Foreign Application Priority Data

Jun. 9, 2014 (CA) ..... 2854065

(51) Int. Cl.
*E21B 17/06* (2006.01)
*E21B 23/14* (2006.01)
(Continued)

(52) U.S. Cl.
CPC ..... *E21B 23/002* (2013.01); *E21B 43/128* (2013.01); *E21B 43/2406* (2013.01); *E21B 47/065* (2013.01)

(58) Field of Classification Search
CPC ..... E21B 43/045; E21B 17/025; E21B 17/06; E21B 17/023; E21B 23/14; E21B 43/128
See application file for complete search history.

(56) References Cited

U.S. PATENT DOCUMENTS 4,082,144 A * 4/1978 Marquis ..... E21B 17/003 166/242.6
4,200,297 A * 4/1980 Tricon ..... E21B 17/025 166/242.5
(Continued)

FOREIGN PATENT DOCUMENTS

CA 2187432 A1 8/1996
CA 2727027 A1 12/2009
(Continued)

*Primary Examiner* — Cathleen R Hutchins
(74) *Attorney, Agent, or Firm* — Baker & Hostetler LLP

(57) ABSTRACT

A transition device for deploying instrumentation below a downhole tool, such as a downhole pump, employed in hydrocarbon recovery operations can include a housing serially connectable between the downhole tool and a guide string insertable into the well ahead of the downhole tool. The transition device can also include a sealable crossover channel extending through the housing and having a proximal and a distal end, the crossover channel providing a crossover path for at least one instrumentation line between an exterior of the transition device at the proximal end and an interior of the guide string at the distal end. The fluid channel can extend through the housing and be radially offset from and capable of establishing fluid communication with the crossover channel, the fluid channel being configured to provide a pressurized fluid into the crossover channel to propel the at least one instrumentation line forward inside the guide string.

19 Claims, 21 Drawing Sheets

(51) Int. Cl.

| | |
|---|---|
| ***E21B 23/12*** | (2006.01) |
| ***E21B 43/12*** | (2006.01) |
| ***E21B 47/06*** | (2012.01) |
| ***E21B 43/24*** | (2006.01) |

(56) References Cited

U.S. PATENT DOCUMENTS

| | | | | |
|---|---|---|---|---|
| 4,506,729 | A * | 3/1985 | Davis, Jr. | E21B 17/025 166/242.5 |
| 7,857,060 | B2 | 12/2010 | Thompson | |
| 2011/0079401 | A1* | 4/2011 | Gambier | E21B 23/08 166/384 |
| 2015/0325943 | A1* | 11/2015 | Frey | H01R 13/512 439/275 |

FOREIGN PATENT DOCUMENTS

| | | | |
|---|---|---|---|
| EP | 0465543 | B1 | 6/1995 |
| WO | 2009113894 | A1 | 9/2009 |

* cited by examiner

WELL INSTRUMENTATION DEPLOYMENT PAST A DOWNHOLE TOOL FOR IN SITU HYDROCARBON RECOVERY OPERATIONS

REFERENCE TO RELATED APPLICATION

This application claims the priority of Canadian application No. 2,854,065, filed Jun. 9, 2014, the entire contents of which are incorporated herein by reference.

TECHNICAL FIELD

The technical field generally relates to in situ hydrocarbon recovery operations, such as Steam-Assisted Gravity Drainage (SAGD), and more particularly, to techniques involving downhole deployment of well instrumentation for enhanced in situ hydrocarbon recovery.

BACKGROUND

There are a number of in situ techniques for recovering hydrocarbons, such as heavy oil and bitumen, from subsurface reservoirs. Thermal in situ recovery techniques often involve the injection of a heating fluid, such as steam, in order to heat and thereby reduce the viscosity of the hydrocarbons to facilitate recovery. One technique, called Steam-Assisted Gravity Drainage (SAGD), has become a widespread process for recovering heavy oil and bitumen, particularly in the oil sands of northern Alberta. The SAGD process involves well pairs, each pair having two horizontal wells drilled in the reservoir and aligned in spaced relation one on top of the other. The upper horizontal well is a steam injection well and the lower horizontal well is a production well.

A SAGD operation typically begins in startup mode, in order to establish fluid communication between the injection well and the production well. After startup, the production well can be recompleted for mechanical lift. Mechanical lift can involve the installation of a downhole pump, such as an electric submersible pump (ESP), at the end of an associated production line to provide the hydraulic force for lifting production fluids to the surface via the associated production line. When a production well is completed with a downhole pump, instrumentation including, for example, optical fibers, thermocouples and/or pressure sensors, can be provided running from the surface downward along the pump production line and terminating at and clamped to the downhole pump.

The use of a downhole pump, such as an ESP, involves a number of challenges. For example, the installation of a downhole pump can limit or prevent the possibility of running instrumentation and/or carrying out logging or other operations below the pump into the producing interval of the well. In some scenarios, however, it can be desirable or necessary to monitor reservoir characteristics and/or process conditions below the pump to facilitate evaluation of different parameters (e.g., temperatures, pressures, flow rates, etc.) along the horizontal portion of the well and, in turn, manage well operations based on the collected data.

Conventional methods of getting instrumentation past a downhole pump deployed in a wellbore can involve time-consuming, extensive, and costly wellbore, wellhead and flowline modifications, and represent considerable downtime with various associated inefficiencies. Accordingly, various challenges still exist in the area of techniques for downhole deployment of well instrumentation in thermal in situ hydrocarbon recovery operations.

SUMMARY

In some implementations, there is provided a production assembly for in situ hydrocarbon recovery operations along a production well, including:

- a downhole pump deployed into the production well;
- a guide string deployed into the production well ahead of the downhole pump;
- at least one instrumentation line deployed into the production well inside the guide string; and
- a transition device serially connected between the downhole pump and the guide string, including:
  - a housing having a proximal end connected to the downhole pump and a distal end connected to the guide string;
  - a crossover channel extending through the housing and providing a crossover path for the at least one instrumentation line between an exterior of the transition device at the proximal end and an interior of the guide string at the distal end;
  - a sealing assembly including a plurality of high-temperature-resistant packing elements sized and shaped to seal the crossover channel around the at least one instrumentation line; and
  - a fluid channel extending through the housing radially offset from the crossover channel, wherein the fluid channel is sealed during a production mode and fluidly connected to the crossover channel during a deployment mode in order to supply a pressurized fluid into the crossover channel so as to propel the at least one instrumentation line forward inside the guide string.

In some implementations, the transition device includes a quick connect coupling provided at the proximal end of the housing for connection to the downhole pump.

In some implementations, the housing includes, from the proximal end to the distal end thereof:

- a canister portion housing parallel tubular sections defining the crossover channel and the fluid channel, and a Y-branch body having a crossover channel input, a fluid channel input and a guide string output; and
- a pup joint assembly providing a path for the at least one instrumentation line between the guide string output of the Y-branch body and the guide string.

In some implementations, the guide string includes:

- a perforated segment having a closed forward extremity; and
- a plurality of string segments serially connected between the transition device and the perforated segment.

In some implementations, the at least one instrumentation line includes a pump down plug at a forward end thereof sized and shaped to propel, during the deployment mode, the at least one instrumentation line forward within the guide string under action of the pressurized fluid.

In some implementations, there is provided a production assembly for hydrocarbon recovery operations along a production well, including:

- a downhole pump deployed into the production well;
- a guide string deployed into the production well ahead of the downhole pump;
- at least one instrumentation line deployed into the production well inside the guide string; and
- a transition device serially connected between the downhole pump and the guide string, including a housing and a crossover channel extending through the housing and having a proximal end and a distal end, the crossover channel providing a crossover path for the at least one instrumentation line between an exterior of the transition device at the proximal end and an interior of the guide string at the distal end.

In some implementations, there is provided an assembly for use in hydrocarbon recovery operations along a well, including:

a downhole tool deployed into the well;

a guide string deployed into the well ahead of the downhole tool;

at least one instrumentation line deployed into the well inside the guide string; and a transition device serially connected between the downhole tool and the guide string, including a housing and a crossover channel extending through the housing and having a proximal end and a distal end, the crossover channel providing a crossover path for the at least one instrumentation line between an exterior of the transition device at the proximal end and an interior of the guide string at the distal end.

In some implementations, the assembly further includes a sealing assembly configured to seal the crossover channel around the at least one instrumentation line.

In some implementations, the sealing assembly includes a plurality of high-temperature-resistance packing elements.

In some implementations, the sealing assembly includes:

a pack-off sleeve:

a pair of packing elements in contact with opposed ends of the pack-off sleeve;

a pair of pack-off rings each of which sandwiching a corresponding one of the pair of packing elements against the pack-off sleeve;

a pack-off body housing the pack-off sleeve, the pair of packing elements and the pair of pack-off rings, the pack-off body having a having a distal end connected to the proximal end of the crossover channel and a proximal end; and a pack-off nut connected to the proximal end of the pack-off body, the pack-off nut compressing and retaining in fixed position the pack-off sleeve, the pair of packing elements and the pair of pack-off rings.

In some implementations, the pack-off sleeve, the pair of pack-off rings, the pack-off body and the pack-off nut are each made of a metallic material, and wherein the pair of packing elements are made of a compressible material.

In some implementations, the compressible material is a rubber material, a polymer material, an elastomer material or a thermoplastic material.

In some implementations, there is provided the sealing assembly further includes a thrust bearing positioned between the pack-off nut and a proximal one of the pair of pack-off rings, the thrust bearing being configured to provide sufficient compression force to the pair of packing elements to maintain a seal around the at least one instrumentation line while deploying the at least one instrumentation line inside the guide string.

In some implementations, the assembly further includes a fluid channel extending through the housing radially offset from the crossover channel, wherein the fluid channel is sealed during a production mode and fluidly connected to the crossover channel during a deployment mode in order to supply a pressurized fluid into the crossover channel so as to propel the at least one instrumentation line forward inside the guide string.

In some implementations, the at least one instrumentation line includes a plug at a forward end thereof sized and shaped to propel, during the deployment mode, the at least one instrumentation line forward within the guide string under action of the pressurized fluid.

In some implementations, the transition device includes a quick connect coupling provided at a proximal end thereof for connection to the downhole tool.

In some implementations, the quick connect coupling includes a lower member defining the proximal end of the transition device and an upper member connected to the downhole tool, the lower member and the upper member configured for mating engagement so as to enable control over a relative orientation of the transition device and the downhole tool upon connection therebetween.

In some implementations, the quick connect coupling further includes a retaining member preventing relative axial movement and disconnection of the lower and upper members.

In some implementations, the transition device includes:

a canister portion housing parallel tubular sections defining the crossover channel and the fluid channel, and a Y-branch body having a crossover channel input, a fluid channel input and a guide string output; and a pup joint assembly providing a path for the at least one instrumentation line between the guide string output of the Y-branch body and the guide string.

In some implementations, the guide string includes:

a perforated segment having a closed forward extremity; and a plurality of string segments serially connected between the transition device and the perforated segment.

In some implementations, the downhole tool, the guide string and the transition device are provided in a substantially coaxial arrangement with respect to one another.

In some implementations, the downhole tool is an electrical submersible pump (ESP).

In some implementations, the downhole tool is located at or near a heel of the well.

In some implementations, the guide string extends to a toe of the well.

In some implementations, the at least one instrumentation line is configured to remain in place upon removal of the downhole tool from the well for maintenance, inspection or replacement.

In some implementations, the at least one instrumentation line is clamped onto an exterior of the downhole tool.

In some implementations, the at least one instrumentation line includes one or more of an optical fiber, a thermocouple, a bubble tube, a pressure sensor and an acoustic sensor.

In some implementations, the at least one instrumentation line includes a plurality of fiber-optic temperature sensors.

In some implementations, each of the at least one instrumentation line includes a capillary tube and distributed sensing elements inserted in the capillary tube.

In some implementations, there is provided a transition device for use with a downhole pump employed for hydrocarbon recovery operations along a production well and with a guide string insertable into the production well ahead of the downhole pump, including:

a housing serially connectable between the downhole pump and the guide string;

a sealable crossover channel extending through the housing and having a proximal end and a distal end, the crossover channel providing a crossover path for at least one instrumentation line between an exterior of the transition device at the proximal end and an interior of the guide string at the distal end; and a fluid channel extending through the housing radially offset from and capable of establishing fluid communication with the crossover channel, the fluid channel being configured to provide a pressurized fluid into the crossover channel in order to propel the at least one instrumentation line forward inside the guide string.

In some implementations, there is provided a transition device for use with a downhole pump employed for in situ hydrocarbon recovery operations along a production well and with a guide string insertable into the production well ahead of the downhole pump, including:

a housing having a proximal end connectable to the downhole pump and a distal end connectable to the guide string;

a quick connect coupling provided at the proximal end of the housing for connection to the downhole pump;

a crossover channel extending through the housing and providing a crossover path for at least one instrumentation line between an exterior of the transition device at the proximal end and an interior of the guide string at the distal end;

a sealing assembly including a plurality of high-temperature-resistant packing elements sized and shaped to seal the crossover channel around the at least one instrumentation line; and a fluid channel extending through the housing radially offset from and in fluid communication with the crossover channel, configured to provide a pressurized fluid into the crossover channel in order to propel the at least one instrumentation line forward inside the guide string.

In some implementations, the quick connect coupling includes a lower member defining the proximal end of the housing and an upper member connectable to the downhole pump, the lower member and the upper member being configured for mating engagement so as to enable control over a relative orientation of the transition device and the downhole pump upon connection therebetween.

In some implementations, the quick connect coupling further includes a retaining member preventing relative axial movement and disconnection of the lower and upper members.

In some implementations, the transition device further includes, from the proximal end to the distal end of the housing:

a canister portion housing parallel tubular sections defining the crossover channel and the fluid channel, and a Y-branch body having a crossover channel input, a fluid channel input and a guide string output; and a pup joint assembly providing a path for the at least one instrumentation line between the guide string output of the Y-branch body and the guide string.

A transition device for use with a downhole tool employed in hydrocarbon recovery operations along a production well and with a guide string insertable into the production well ahead of the downhole tool, including:

a housing serially connectable between the downhole tool and the guide string;

a sealable crossover channel extending through the housing and having a proximal end and a distal end, the crossover channel providing a crossover path for at least one instrumentation line between an exterior of the transition device at the proximal end and an interior of the guide string at the distal end; and a fluid channel extending through the housing radially offset from and capable of establishing fluid communication with the crossover channel, the fluid channel being configured to provide a pressurized fluid into the crossover channel in order to propel the at least one instrumentation line forward inside the guide string In some implementations, the transition device further includes a sealing assembly configured to seal the crossover channel around the at least one instrumentation line.

In some implementations, the sealing assembly includes a plurality of high-temperature-resistance packing elements.

In some implementations, the sealing assembly includes:

a pack-off sleeve:

a pair of packing elements in contact with opposed ends of the pack-off sleeve;

a pair of pack-off rings each of which sandwiching a corresponding one of the pair of packing elements against the pack-off sleeve;

a pack-off body housing the pack-off sleeve, the pair of packing elements and the pair of pack-off rings, the pack-off body having a having a distal end connected to the proximal end of the crossover channel and a proximal end; and a pack-off nut connected to the proximal end of the pack-off body, the pack-off nut compressing and retaining in fixed position the pack-off sleeve, the pair of packing elements and the pair of pack-off rings.

In some implementations, the pack-off sleeve, the pair of pack-off rings, the pack-off body and the pack-off nut are each made of a metallic material, and wherein the pair of packing elements are made of a compressible material.

In some implementations, the compressible material is a rubber material, a polymer material, an elastomer material or a thermoplastic material.

In some implementations, the sealing assembly further includes a thrust bearing positioned between the pack-off nut and a proximal one of the pair of pack-off rings, the thrust bearing being configured to provide sufficient compression force to the pair of packing elements to maintain a seal around the at least one instrumentation line while deploying the at least one instrumentation line inside the guide string.

In some implementations, the transition device further include a quick connect coupling provided at a proximal end thereof for connection to the downhole tool.

In some implementations, the quick connect coupling includes a lower member defining the proximal end of the transition device and an upper member connectable to the downhole tool, the lower member and the upper member being configured for mating engagement so as to enable control over a relative orientation of the transition device and the downhole tool upon connection therebetween.

In some implementations, the quick connect coupling further includes a retaining member preventing relative axial movement and disconnection of the lower and upper members.

In some implementations, the transition device further includes:

a canister portion housing parallel tubular sections defining the crossover channel and the fluid channel, and a Y-branch body having a crossover channel input, a fluid channel input and a guide string output; and a pup joint assembly providing a path for the at least one instrumentation line between the guide string output of the Y-branch body and the guide string.

DETAILED DESCRIPTION

Figure 1:
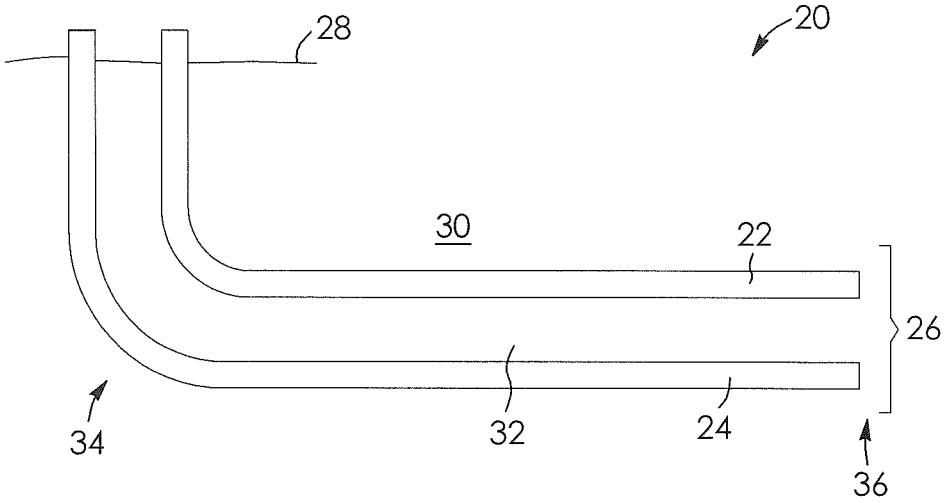
FIG. 1 is a side cross-sectional view schematic of a SAGD well pair.

Various techniques are described for deploying instrumentation lines past a downhole tool received in a well of a hydrocarbon recovery operation. In some implementations, a transition device is serially connected between a downhole pump and a guide string extending in the horizontal portion of a production well, and is provided with two laterally offset and independently sealable channels. One channel is a crossover channel along which instrumentation lines transition from being outside of the transition device to being inside of the guide string. The other channel is a fluid channel through which pressurized fluid can be delivered into the crossover channel in order to propel the instrumentation lines down the guide string.

In some implementations, once instrumentation lines have been pumped down into the guide string, the fluid channel is sealed and the pump, transition device, instrumentation lines, and guide string are together deployed downhole as a single production assembly, in which the pump and instrumentation lines can be independently replaced or maintained. For example, in the event the pump has to be pulled for inspection, maintenance or replacement, the instrumentation lines can be sealed or packed off in the crossover channel to ensure containment of the wellbore production fluids within the well.

An existing method of getting instrumentation below a downhole pump involves deploying the instrumentation in a separate guide string running adjacent the pump production line. However, such a method typically entails extensive and time-consuming wellhead modifications, limits the annular space in the wellbore, and makes achieving proper positioning of the downhole instrumentation difficult. Also, the presence of an adjacent guide string can contribute to reducing the run-life of the pump. Other existing methods can also result in significant wellhead, wellbore and/or flowline modifications, which can lead to a number of disadvantages, such as an excessively high wellhead that is inefficient to operate and involves compromises in safety, and delayed production with the associated economic downside.

In contrast to existing methods, in some implementations, the techniques described herein enable instrumentation lines to be deployed below a downhole pump and along the producing interval of the well with no or minimal downhole and/or surface modifications, thus avoiding down time and reducing associated recompletion costs. In addition, by sealing or packing off the crossover channel of the transition device, the instrumentation can be decoupled from the downhole pump, allowing the pump to be pulled and replaced without having to pull the instrumentation out of the guide string. This can be advantageous when considering that downhole pumps typically require inspection, maintenance or replacement before the instrumentation, and that pulling the instrumentation out of the guide string with unnecessary frequency can subject the instrumentation to risk of damage, which is best reduced or avoided.

Furthermore, in some implementations, by providing the transition device in a serial arrangement with the pump and the guide string, obstruction of the annular space around the pump can be reduced or avoided. A number of advantages can be achieved with this arrangement including one or more of the following:

- Instrumentation bypassing a downhole pump and deployed to the toe of a production well independently of the position of the pump within the wellbore;
- Production from the toe of a production well; and/or
- Steam injection to the toe of a production well. More regarding the various operational and structural features of the techniques will be described in greater detail below.

It should be noted that the transition device according to the techniques described herein is not limited for use with a downhole pump, but can be applicable to deploy instrumentation below other types of downhole tools and equipment where it is desirable or necessary that instrumentation be passed through or around the downhole tool or equipment to enter a guide string deployed below the downhole tool or equipment. In some implementations, the instrumentation can also be clamped externally to a piping, string or tubing above the downhole tool or equipment. The various techniques described herein can be applicable to production, injection and observation wells. In addition, in some implementations, the transition device could be applicable to deploy not only instrumentation lines, but also other equipment such as, for example, chemical injection lines to the toe of horizontal wellbores.

Throughout the present specification, the terms "above", "upper", "upward", "upstream" and similar terms refer to a direction closer to the head of a wellbore, while the terms "ahead", "below", "forward", "downward", "lower", "downstream" and similar terms refer to a direction closer to the bottom of the wellbore. Additionally, the term "proximal" refers to a location, an element, or a portion of an element that is further above with respect to another location, element, or portion of the element, while the term "distal" refers to a location, an element, or a portion of an element, that is further below another location, element, or portion of the element.

Production Well Implementations

The various techniques described herein can be implemented in various types of production wells that require or could benefit from having instrumentation or other well equipment deployed below a downhole pump with no or minimal surface and/or downhole modifications. For example, in some implementations, the production well can be part of a SAGD well pair including an overlying SAGD injection well, or can be operated as another production well, such as an infill well or a step-out well, that is part of a SAGD operation. Alternatively, in some implementations, some techniques described herein can be used for Cyclic Steam Stimulation (CSS) wells or In Situ Combustion (ISC) wells.

Referring to FIG. 1, a SAGD operation 20 can include an injection well 22 overlying a production well 24 to form a well pair 26. Each well includes a vertical or slanted section extending from the surface 28 into the hydrocarbon-containing reservoir 30, and a generally horizontal section that extends within a pay zone of the hydrocarbon-containing reservoir 30. The injection well 22 and the production well 24 are separated by an interwell region 32 that is typically immobile at initial reservoir conditions. During startup mode, the interwell region 32 is mobilized by introducing heat, typically conveyed by a mobilizing fluid such as steam, into one or more of the wells.

In some implementations, steam is injected into the injection well 22 and the production well 24 to heat the interwell region 32 and mobilize the hydrocarbons to establish fluid communication between the two wells. Other mobilizing fluids, such as organic solvents, can also be used to mobilize the reservoir hydrocarbons by heat and/or dissolution mechanisms. The well pair 26 also has a heel 34 and a toe 36, and it is often desired to circulate the mobilizing fluid along the entire length of the wells. Once the well pair 26 has fluid communication between the two wells, the well pair 26 can be converted to normal operation where steam is injected into the injection well 22 while the production well 24 is operated in production mode to supply hydrocarbons to the surface 28.

Figure 2:
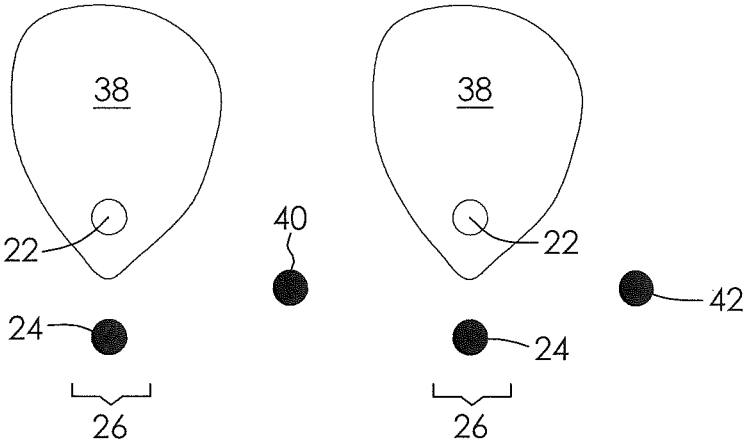
FIG. 2 is a front cross-sectional view schematic of a SAGD well pair, an infill well and a step-out well.

Turning briefly to FIG. 2, SAGD well pairs 26 can be arranged in generally parallel relation to each other to form an array of well pairs 26. As the SAGD operation 20 progresses, steam chambers 38 form and grow above respective injection wells 22. Infill wells 40 can be drilled, completed and operated in between SAGD well pairs, and step-out wells 42 can be drilled, completed and operated adjacent to one SAGD well pair. In some scenarios, such infill and start-up wells can benefit from the various techniques described herein. In particular, since temperature variations along infill wells and step-out wells are often more pronounced than along well pair production wells, providing distributed temperature sensing instrumentation along the horizontal portion of infill wells and step-out wells can provide information as to well conformance as the well is produced to determine the progress of full chamber development along the well. Furthermore, in some implementations, as infill wells and step-out wells do not have corresponding injector wells, instrumentation has to be deployed inside the infill wells and step-out wells themselves.

Production Well Completion

Figure 3:
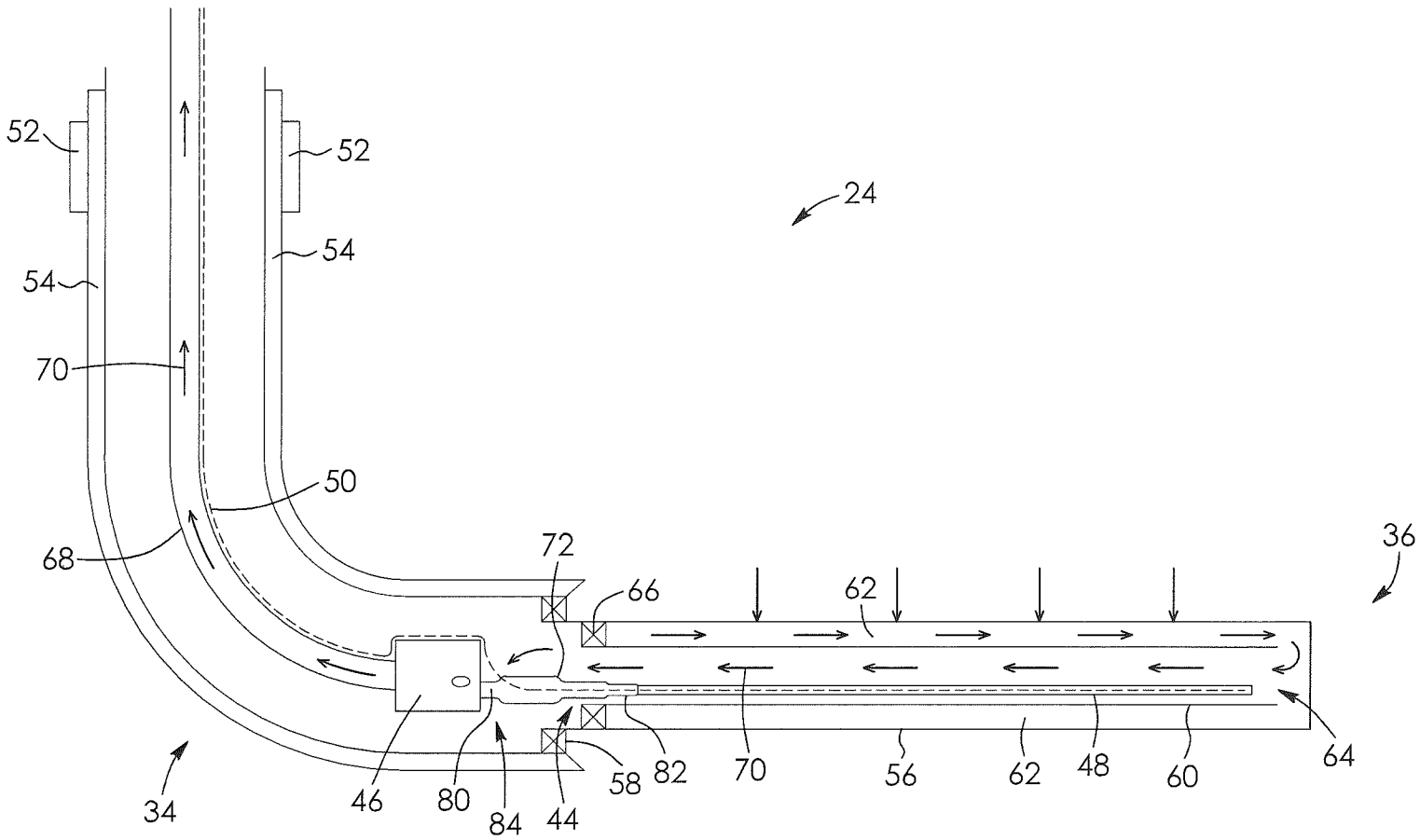
FIG. 3 is a side cross-sectional view schematic of a production well including a downhole pump, a guide string, instrumentation deployed in the guide string, and a transition device between the pump and the guide string, in a production mode.

Referring to FIG. 3, the production well 24 includes a transition device 44, which is serially connected between a downhole pump 46 and a guide string 48 and also enables the deployment of instrumentation 50 within the guide string 48, past the pump 46 and into the horizontal portion of the well 25. More regarding the construction and operation of the transition device 44 will be discussed further below.

Referring still to FIG. 3, in some implementations the production well 24 is completed with tubing and/or liner structures. The production well completion can also include devices for flow control, isolation, artificial lifting and pumping, instrumentation deployment, gravel packing and/or various other completion structures for ensuring functionality and stability of the production well 24. The completion design can allow for the deployment and operation of the instrumentation 50 below the downhole pump 46, in accordance with the various techniques described herein. It should be noted that the production well 24 can assume different constructions and configurations, depending on the particularities of the hydrocarbon recovery process in which the well is employed and the components used to complete the well.

In some implementations, the production well 24 includes a surface casing 52 provided at an inlet of the wellbore proximate the surface, and an intermediate casing 54 provided within the wellbore and extending from the surface downward into the reservoir in the vertical or slanted section of the wellbore, in the curved intermediate section of the wellbore, and in part of the horizontal section of the wellbore at the heel 34. The production well 24 can also include a liner 56 provided in the horizontal portion of the wellbore. The liner 56 can be installed by connection to a distal part of the intermediate casing 54 via a liner packer 58. The liner 56 can have various constructions including various slot patterns, blank sections, and other features designed for the given application and reservoir characteristics.

In some implementations, the production well 24 can also include a tailpipe 60 sized for insertion into the liner 56 and defining an annulus 62 between an inner surface of the liner 56 and an outer surface of the tailpipe 60. The tailpipe 60 can extend from a location proximate to and above the liner packer 58 to the toe 36 of the production well 24, where the tailpipe 60 has a distal opening 64 through which fluids can flow. The tailpipe 60 can be installed to a proximal part of the liner 56 via a tailpipe packer 66. The tailpipe packer 66 can seal the proximal end of the tailpipe 60 and thus force hydrocarbon-containing fluids flowing through slots in the walls of the liner 56 and into the annulus 62 to enter the tailpipe 60 through the distal opening 64 of the tailpipe 60.

In some implementations, the pump 46 can be attached at the end of an associated production line 68 and received inside the intermediate casing 54 in order to provide a hydraulic force for enabling displacement of production fluids 70 toward the surface. The pump 46 can be an electrical submersible pump (ESP) or another artificial lift device, and be located at various different locations within the well 24. For example, the pump 46 can be located proximate and just upstream (e.g., a few meters) from the liner packer 58.

FIG. 3 also illustrates fluid flow during production mode. Mobilized hydrocarbons flow through slots in the walls of the liner 56 and enter the annulus 62 defined between the tailpipe 60 and the liner 56. In some scenarios, the production fluids 70 flow toward the toe 36 of the well 24 where the fluids 70 enter the distal opening 64 of the tailpipe 60 and then flow toward the heel 34 of the well 24 within the tailpipe 60. Hydraulic force for enabling displacement of the production fluids 70 is provided by the pump 46. The pump production line 68 includes a tubing through which production fluids 70 pumped by the pump 46 can be supplied to the surface where the production fluids 70 can be processed.

Referring still to FIG. 3, the instrumentation 50 can be provided extending along a length of the production well 24. The instrumentation 50 can include one or more instrumentation lines and be provided with various devices for detecting or measuring characteristics of the reservoir and/or the process conditions. The instrumentation 50 can include optical fibers, thermocouples, bubble tubes, pressure sensors and/or acoustic sensors. For example, in some implementations, the instrumentation 50 can include a plurality of fiber-optic temperature sensors distributed along the horizontal section of the well 24 for monitoring the temperature of the production fluids 70. The instrumentation 50 can be configured to measure and transmit data regarding various operational and/or reservoir characteristics, such as temperatures, pressures, seismic events, etc. before and/or during operation of the production well 24. The operating conditions of the well 24 can be regulated based on the data collected via the instrumentation 50 deployed in the wellbore.

In some implementations, the instrumentation 50 extends from the surface downward along the outside of the pump production line 68 and is clamped onto the exterior of the pump 46. The instrumentation 50 then reaches the transition device 44, at which point the instrumentation 50 crosses over internally and is run down within the guide string 48. The construction, operation, and deployment of the transition device 44 will now be described.

General Construction of Transition Device Implementations

Figure 4:
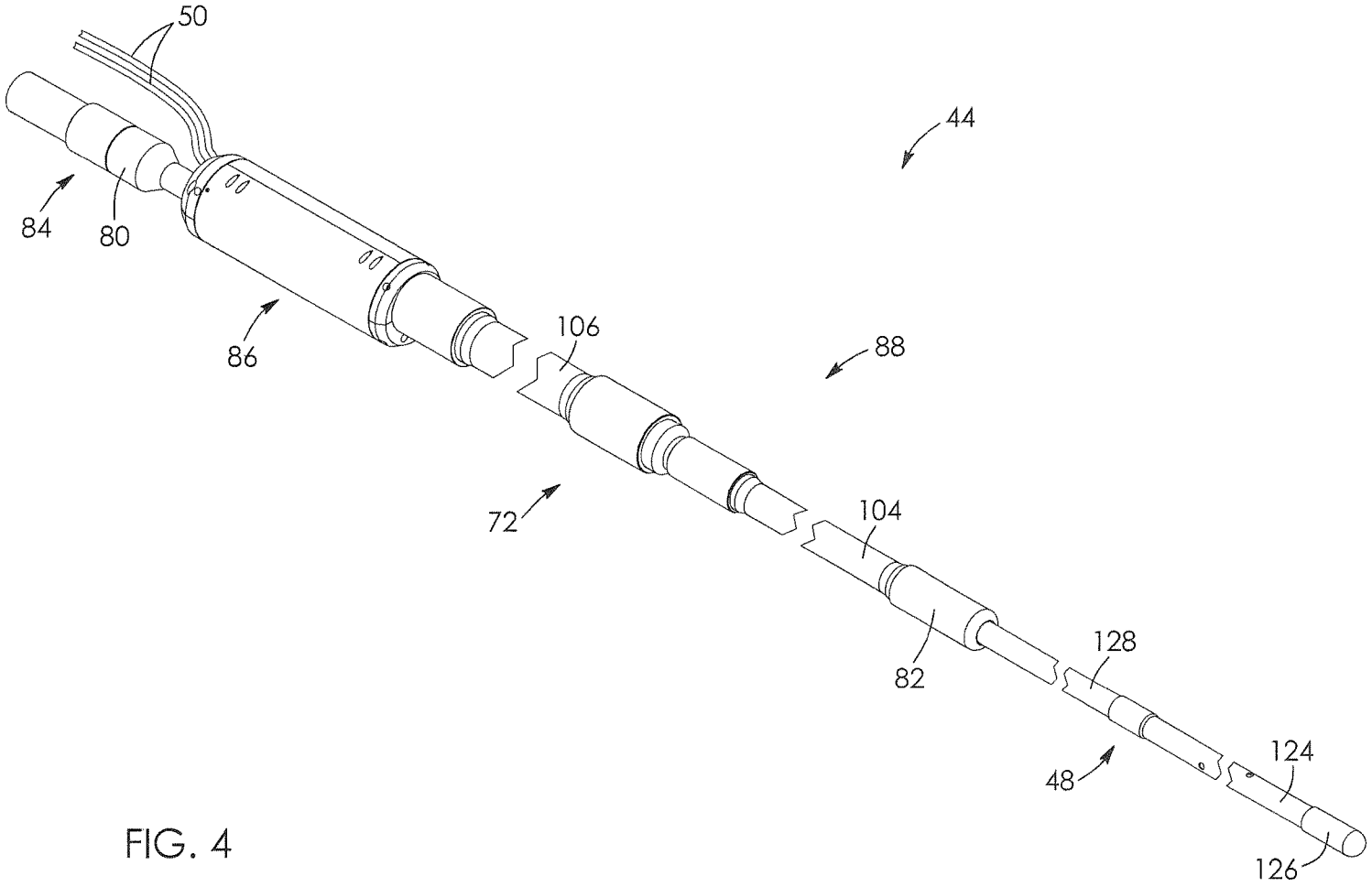
FIG. 4 is a perspective view schematic of a transition device connected to a guide string.
Figure 5:
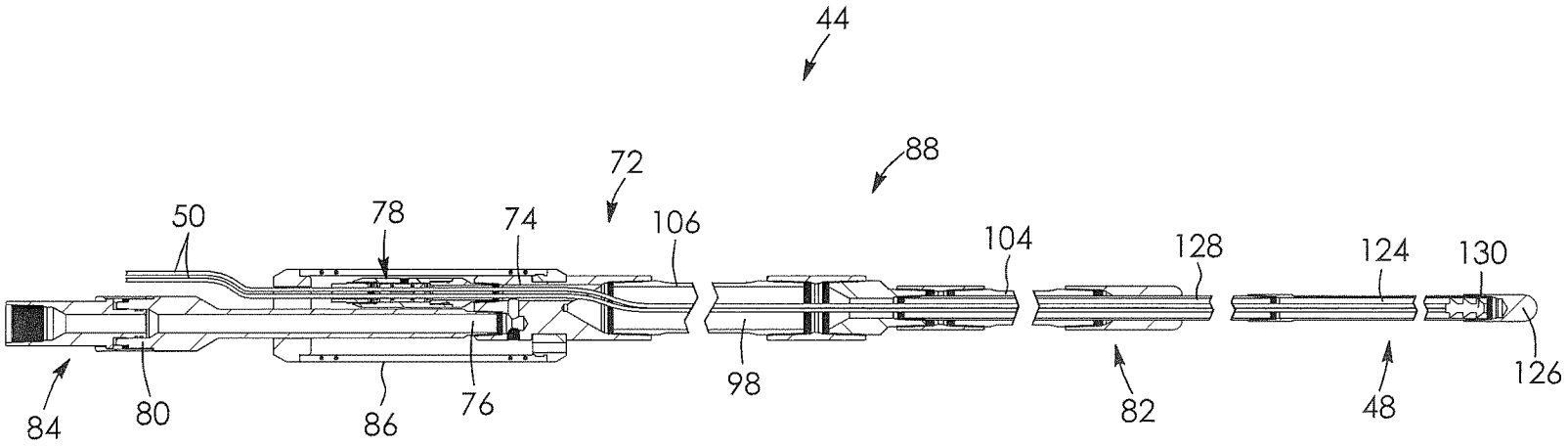
FIG. 5 is a side cross-sectional view schematic of a transition device connected to a guide string.
Figure 6:
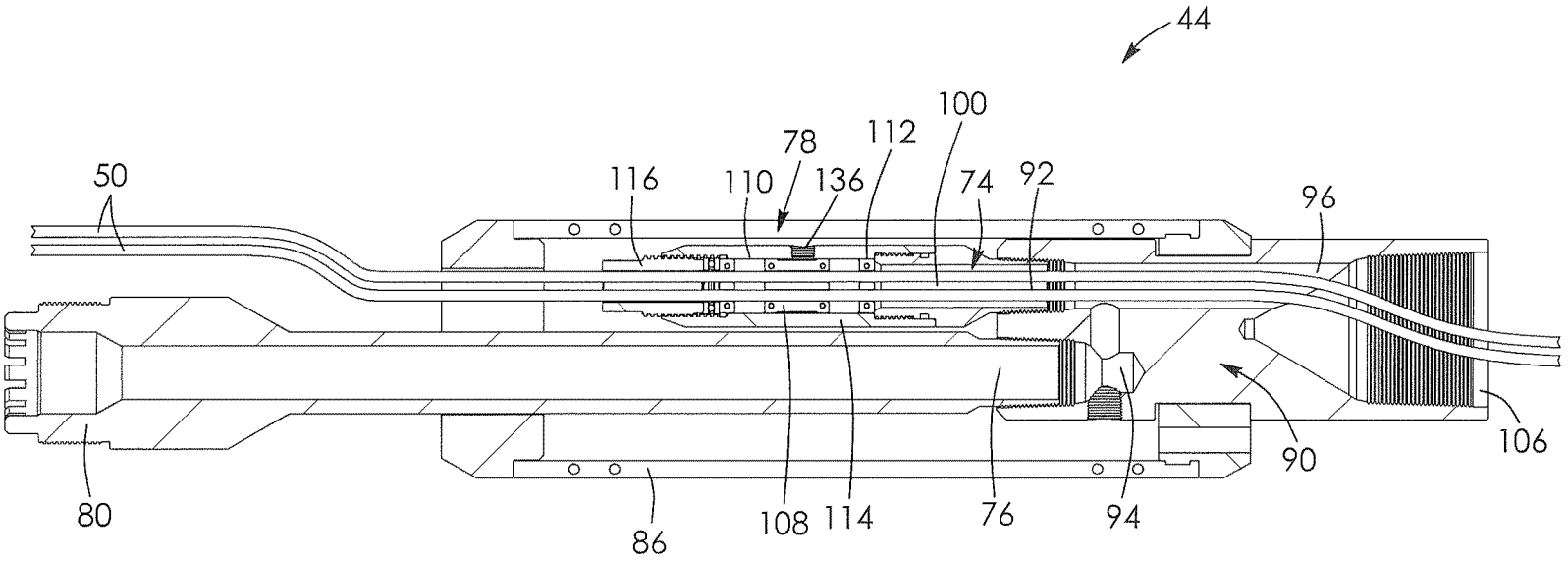
FIG. 6 is a side cross-sectional view schematic of part of a transition device.

Referring to FIGS. 4 to 6, the general construction of an implementation of the transition device 44 is illustrated. Broadly described, the transition device 44 can include a housing 72, a crossover channel 74, a fluid channel 76, and a sealing assembly 78. More regarding the components of the transition device 44 will be discussed further below.

Returning briefly to FIG. 3, the housing 72 has a proximal end 80 and a distal end 82 configured for connection to the downhole pump 46 and the guide string 48, respectively. The housing 72 generally defines the overall size and shape of the transition device 44, and includes, connects and/or supports the different components of the transition device 44. In some implementations, obstruction of the flow area around the pump 46 can be reduced or avoided by providing the transition device 44 in a substantially coaxial arrangement with the pump 46 and the guide string 48, and by ensuring that the largest outer diameter along the length of the transition device 44 does not exceed the largest outer diameter along the length of the pump 46. The transition device 44 can include a quick connect coupling 84 provided at the proximal end 80 of the housing 72 for connection to the downhole pump 46. More regarding the quick connect coupling 84 will be discussed further below.

Returning to FIGS. 4 to 6, in some implementations, the housing 72 includes, from the proximal end 80 to the distal end 82, a canister portion 86 and a pup joint assembly 88. The canister portion 86 can house parallel tubular sections defining the crossover channel 74 and the fluid channel 76, so that the crossover channel 74 and the fluid channel 76 can constitute two independently sealable channels in the transition device 44. The canister portion can also house a Y-branch body 90 having a crossover channel input 92 connected to the distal end of the crossover channel 74, a fluid channel input 94 connected to the distal end of the fluid channel 76 and a guide string output 96 connected to the proximal end of the guide string 48. The canister portion 86 can be provided to help reinforce the structure of the transition device 44 and protect the components housed by the canister portion 86 from damage when the transition device 44 is deployed downhole. The pup joint assembly 88 can provide a path 98 for the instrumentation lines 50 between the guide string output 96 of the Y-branch body 90 and the guide string 48. More regarding the pup joint assembly 88 will be discussed further below.

Referring still to FIGS. 4 to 6, the crossover channel 74 extends through the housing 72 and provides a crossover path 100 along which the instrumentation lines 50 are fed in order to be pumped down the guide string 48. In particular, by passing through the crossover channel 74, the instrumentation lines 50 transition from being outside of the transition device 44 at the proximal end 80 to being inside of the guide string 48 at the distal end 82. Furthermore, in some implementations, the crossover channel 75 is configured not only to receive and accommodate the instrumentation lines 50, but also to be sealed against the flow of fluids, for example, during well production, instrumentation deployment and/or pump removal operations. In order to prevent the flow of fluids across the crossover channel 74, the transition device 44 can include a sealing assembly 78 provided with a packing structure constructed and arranged to seal the crossover channel 74 around the instrumentation lines 50. More regarding the sealing assembly 78 will be discussed further below.

Referring still to FIGS. 4 to 6, in some implementations, the fluid channel 76 extends through the housing 72 parallel to but radially offset from the crossover channel 74. In some implementations, the fluid channel 76 is configured to be sealed during well production and pump removal, but to remain open during instrumentation deployment. In particular, the fluid channel 76 can provide a sealable pathway for delivering, during instrumentation deployment, a pressurized fluid from the surface to the crossover channel 74 in order to propel the instrumentation lines 50 forward inside the guide string 48 and near the toe of the well (not shown in FIGS. 4 to 6). Accordingly, in some implementations, once the instrumentation lines 50 have been pumped down into the guide string 48 by the pressurized fluid supplied to the crossover channel 74 via the fluid channel 76, the fluid channel 76 can be sealed and the pump 46, transition device 44, instrumentation lines 50, and guide string 48 can be together deployed downhole as a single production assembly, as will now be discussed.

Deployment and Production Assembly Implementations

Figure 7:
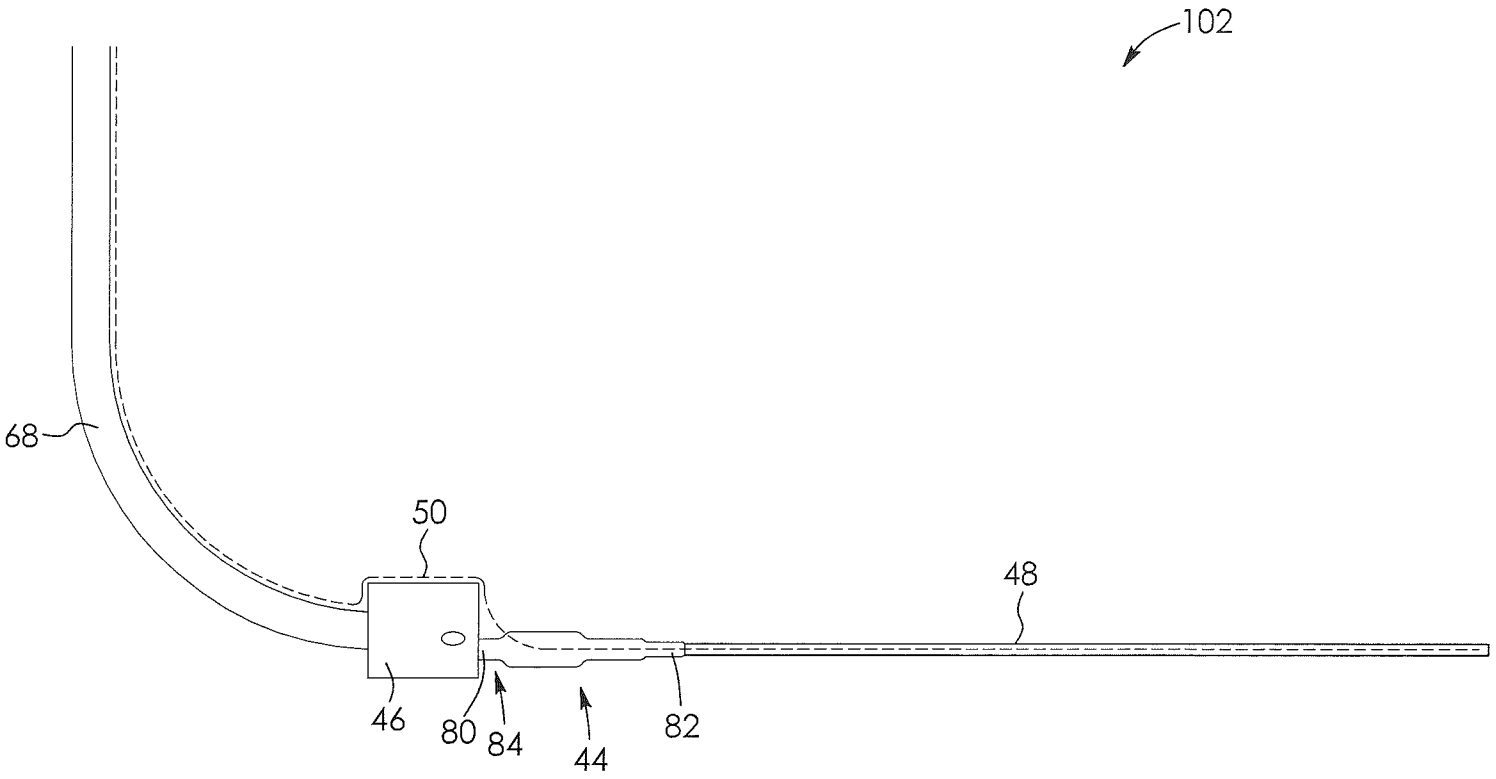
FIG. 7 is a side cross-sectional view schematic of a production assembly.

Referring to FIG. 7, a production assembly 102 includes the transition device 44, the pump 46, the guide string 48, the instrumentation lines 50 and the pump production line 68. Various completion deployment strategies may be undertaken in order to deploy and install a production assembly 102 within a production well. In some implementations, the production assembly can be provided as a pre-assembled apparatus for deployment as a unit into the well. Alternatively, a production assembly kit can be provided for partial or complete assembly prior to deployment. In some implementations, the production assembly 102 is provided with pre-determined dimensions based on other well components and/or on various other factors, such as temperature conditions, pressure conditions, flow rates, friction factors and pressure drops of various fluids to be flowed through the well. In addition, the dimensions can be pre-determined based on well designs that contemplated deploying a production assembly 102 for a hydrocarbon recovery process, or for well designs that did not initially contemplate such a process.

Figure 8:
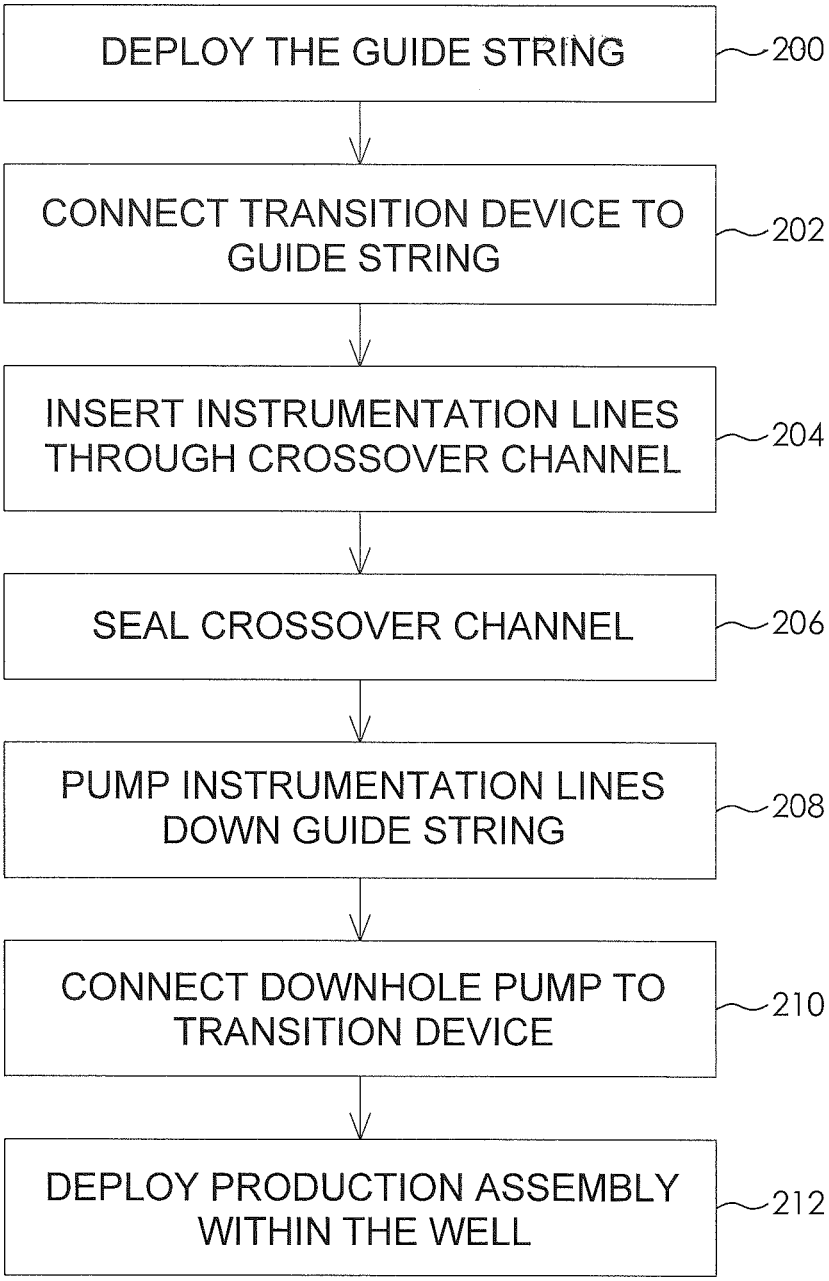
FIG. 8 is a process flow diagram of a completion method for deploying an implementation of a production assembly.

With additional reference to FIG. 8, a completion method for deploying an implementation of the production assembly can include several steps that will be explained in further detail below. It is to be noted that in some implementations some of the steps could be performed in a different order than described herein.

Deployment of the Guide String (200)

Figure 9A:
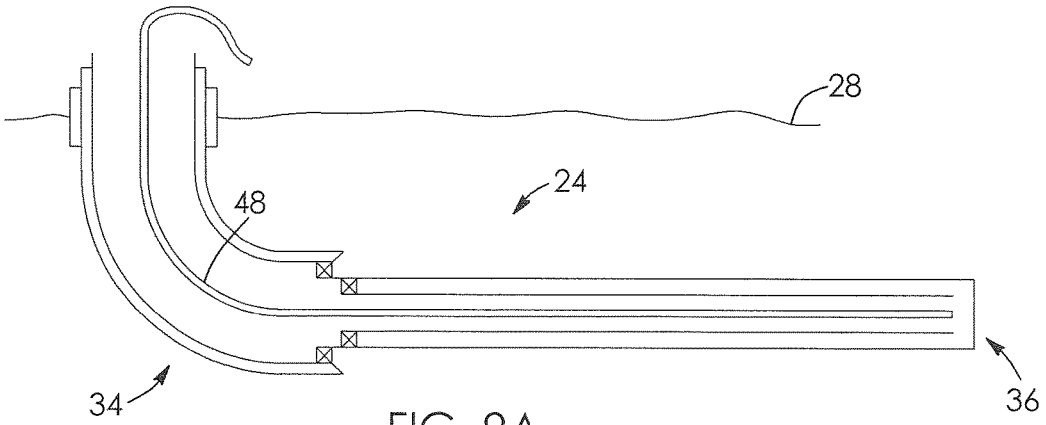
FIGS. 9A to 9H illustrate steps of a completion method for deploying an implementation of a production assembly.

The initial step involves deploying the guide string 48 into the production well 24 by itself, that is, without the other components of the production assembly attached to the guide string 48, as shown in FIG. 9A.

Figure 9B:
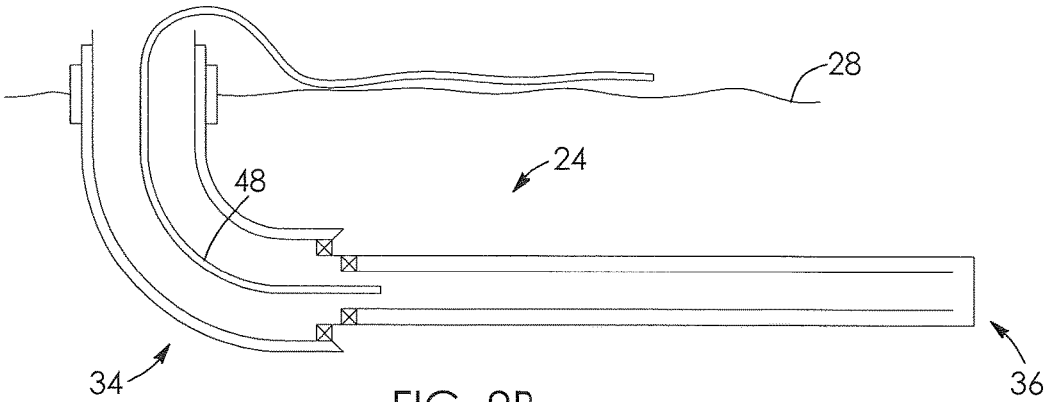
Figure 9C:
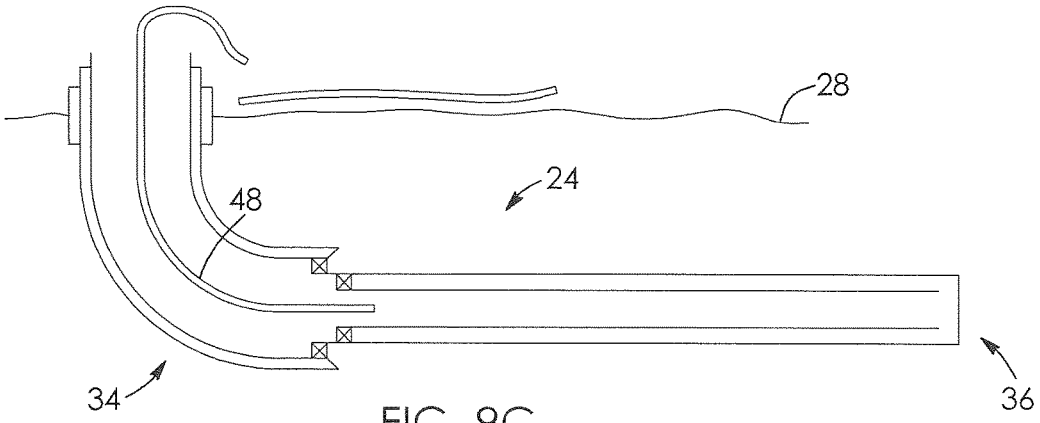

This step, which can be referred to as a "dummy run", can be performed to verify that the guide string 48 can advance to a sufficient or desired depth into the wellbore, for example to or near the toe 36 of the well 24, under its own weight without buckling or otherwise deforming. Because the guide string 48 typically weighs much less than both the pump and transition device, making this dummy run to assess the depth at which the guide string 48 can descend under its own weight can reduce the risk that excessive compression forces are exerted on the guide string 48 when the production assembly is actually deployed into the wellbore. Once the guide string 48 has landed to a sufficient or desired depth into the well 24, the dummy run can involve partially retracting the guide string 48 to the surface 28 until the portion of the guide string 48 that remains in the well 24 corresponds to the intended length of the guide string 48 in the production assembly, as illustrated in FIG. 9B. Then, the dummy run can include removing the extraneous portion of the guide string 48 that has been pulled back to the surface 28, as illustrated in FIG. 9C.

For example, in one scenario, the length of the wellbore from surface to the toe of the well can be 1500 meters and the pump can be landed at a depth of 500 meters into the wellbore, so that the intended length of the guide string in the production assembly is 1000 meters. In such a case, the dummy run would involve a first step of deploying 1500 meters of guide string into the well, followed by a step of pulling back and removing from the well the extraneous 500 meters of guide string corresponding to the pump landing depth, so that only 1000 meters of guide string remain in the well.

The guide string can be provided as any type of tubing string, such as a jointed pipe or coiled tubing, capable of receiving and accommodating the instrumentation lines. The particular size of the guide string can depend on the requirements of the given application. For example, in some implementations, the outer diameter of the guide string can be between about 33 millimeters and about 50 millimeters. It is to be noted that this range is provided for illustrative purposes and the techniques described herein can be operated outside this range. In addition, in some implementations, it is desirable that the diameter and weight of the guide string be kept as small as possible to both maximize the wellbore flow area and minimize the friction drag acting on the guide sting that could lead to excessive compression forces on the downhole pump, while remaining sufficiently large and heavy to house the instrumentation lines and exhibit adequate mechanical strength.

In some implementations, a preliminary cleanout step can be performed prior to the dummy run in order to remove sand and other solid particles from the wellbore. In one scenario, the cleanout process can involve: inserting a cleanout tubing string into the tailpipe, generally down to the toe of the well; pumping a cleanout fluid down into the well; entraining the solid particles into the wash fluid; and carrying the solid particles to the surface. Depending on the given application, the preliminary cleanout process can be implemented using a "direct circulation" technique, in which the cleanout fluid is pumped down the cleanout tubing string and the return fluid travels up inside the annulus defined between the cleanout tubing string and the tailpipe, or a "reverse-circulation" technique, in which the cleanout fluid is pumped down the annulus and the return fluid travels up through the cleanout tubing string. Alternatively, the cleanout fluid can be pumped ahead of the cleanout tubing string and into the formation where circulation is not attainable. Injecting cleanout fluid without using tubing string could also be envisioned in some scenarios.

Connection of the Transition Device to the Guide String (202)

Figure 9D:
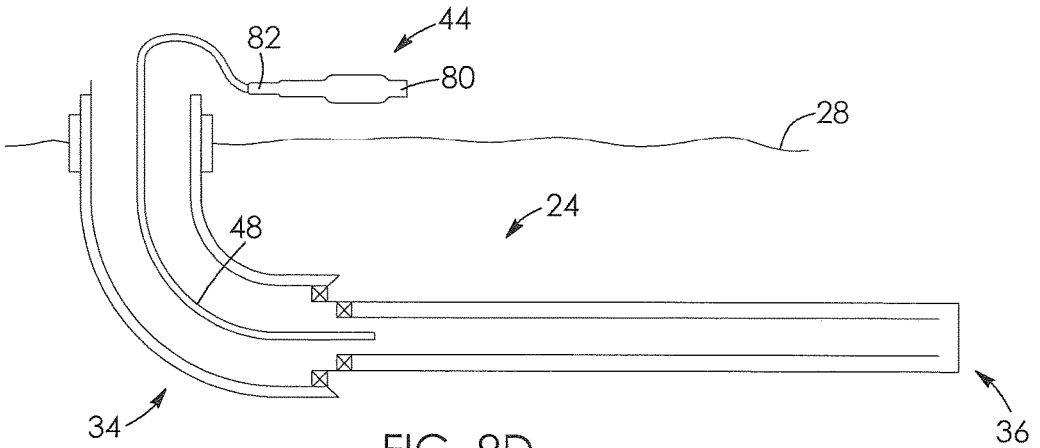

Referring to FIG. 9D, once the distal end of the guide string 48 has been lowered to the intended depth within the wellbore, at the surface 28, the proximal end of the guide string 48 can be connected to the distal end 82 of the transition device 44. In some implementations, the transition device 44 can be provided as a pre-assembled apparatus ready for connection to the proximal end of the guide string 48. Alternatively, the transition device 44 can be provided as a kit of components for partial or complete assembly prior to connection with the guide string 48.

For example, referring back to FIGS. 4 to 6, in one scenario, connecting the transition device 44 to the guide string 48 can involve one or more of the following operations:

- Connection of the distal end of the pup joint assembly 88 to the proximal end of the guide string 48;
- Connection of the guide string output 96 of the Y-branch body 90 to the proximal end of the pup joint assembly 88;
- Connection of the distal end of the crossover channel 74 to the crossover channel input 92 of the Y-branch body 90; and/or
- Connection of the distal end of the fluid channel 76 to the fluid channel input 94 of the Y-branch body 90.

Referring still to FIGS. 4 to 6, in one implementation, the pup joint assembly 88 can include a lower pup joint 104 connected to the guide string 48 and an upper pup joint 106 connected to the guide string output 96 of the Y-branch body 90. The lower pup joint 104 can be sized and configured to stabilize and strengthen the connection between the transition device 44 and the guide string 48. For example, in one implementation, the lower pup joint 104 has a length of about 0.6 meter and an outer diameter of about 60 millimeters.

The upper pup joint 106 can be sized and configured to provide a surface against which the packing unit of a blowout preventer can be press-fitted to seal the annulus between the outer surface of the upper pup joint 106 and the inner surface of the wellbore and thus confine well fluids to the wellbore when the pump is pulled to the surface for inspection, maintenance or replacement, as discussed further below. The outer diameter of the upper pup joint 106 can be selected to lie within the range of pipe diameters which can effectively be sealed by the blowout preventer. For example, in one implementation, the upper pup joint 106 has a length of about 3 meters and an outer diameter of about 90 millimeters. It is to be noted that these values for the dimensions of the lower and upper pup joints are provided for illustrative purpose and the techniques described herein can be operated beyond these values.

Insertion of the Instrumentation Lines Through the Crossover Channel (204)

Figure 9E:
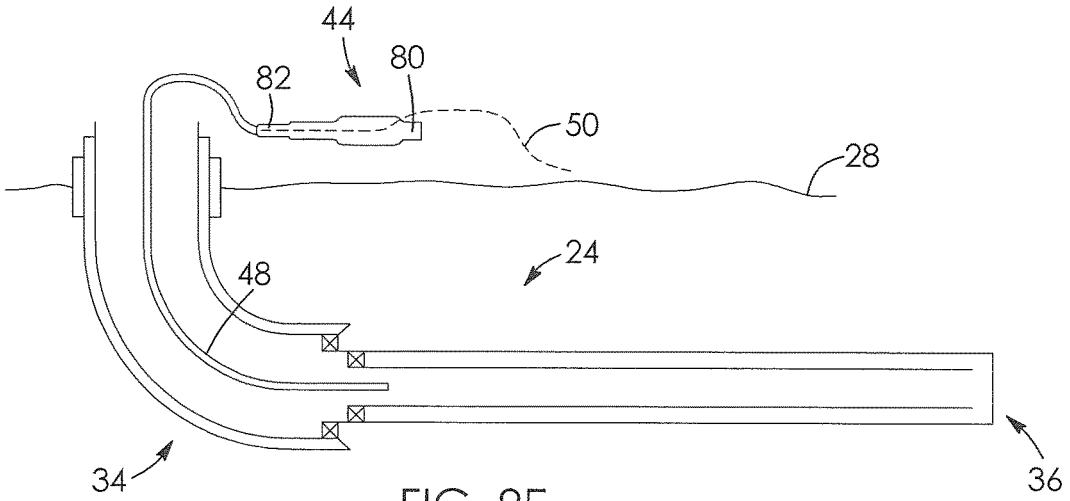
Figure 10:
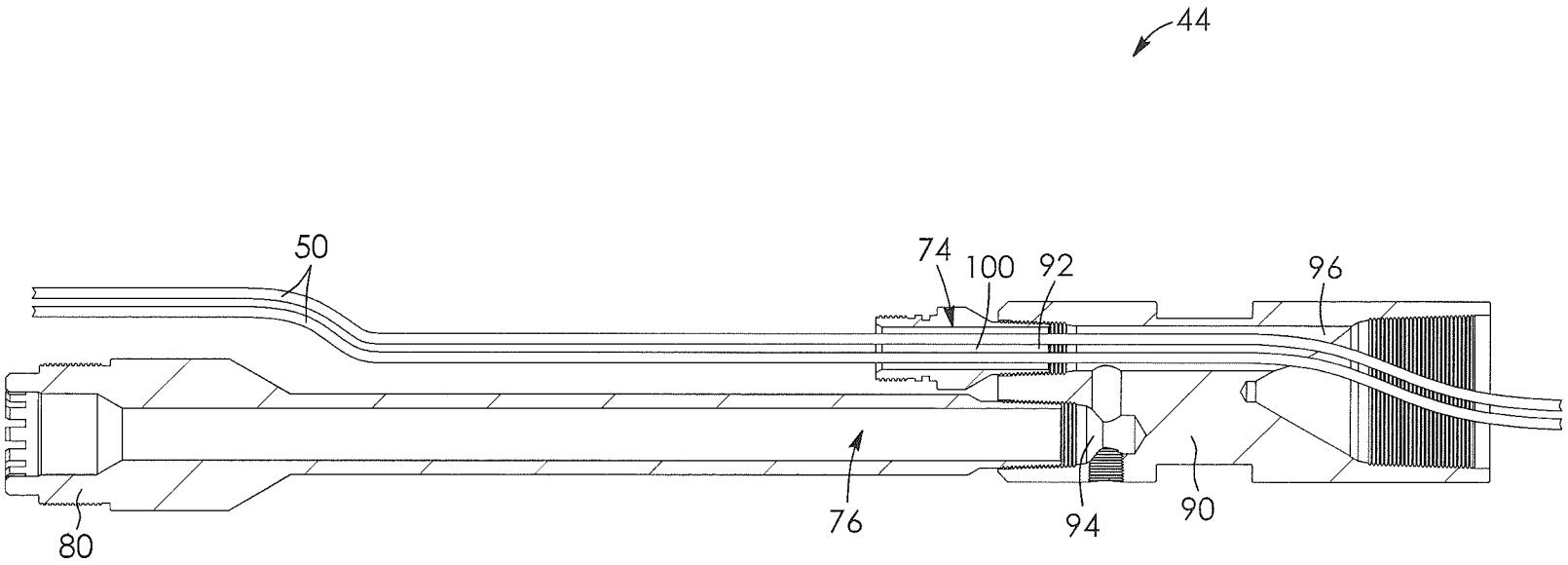
FIG. 10 is a side cross-sectional view schematic of part of a transition device with a canister portion and a sealing assembly removed.

Referring to FIGS. 9E and 10, the distal end of the instrumentation lines 50 are then inserted through the crossover channel 74 of the transition device 44. At this step, the sealing assembly and the canister portion are not yet installed on the transition device 44. The instrumentation lines 50 can be provided as stainless steel capillary tubes in which distributed sensing elements (e.g., fiber-optic-based distributed sensors) are inserted for monitoring reservoir characteristics and/or process conditions along the wellbore.

Sealing of the Crossover Channel (206)

Figure 11:
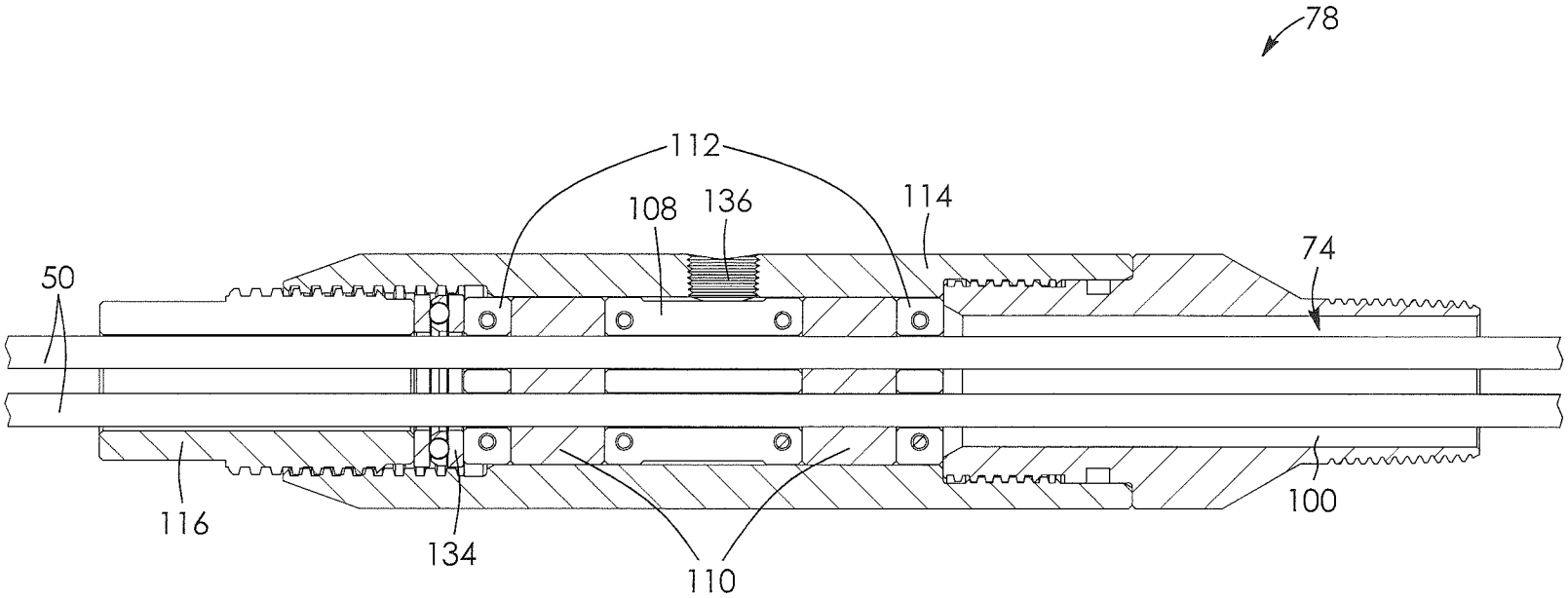
FIG. 11 is a side cross-sectional view schematic of a sealing assembly of a transition device.

Referring to FIG. 11, once the instrumentation lines 50 have been inserted through the crossover channel 74, the crossover channel 74 can be sealed by installing the sealing assembly 78 around the instrumentation lines. Depending on the given application, the sealing assembly 78 can have various constructions and configurations. In particular, the sealing assembly 78 can include a plurality of components cooperating to seal the crossover channel 74 by preventing fluid flow along the instrumentation lines 50.

For example, in the implementation of FIG. 11, the sealing assembly 78 includes a central pack-off sleeve 108, a pair of packing elements 110 positioned in contact with each end of the central pack-off sleeve 108, and a pair of pack-off rings 112 each of which sandwiching a corresponding packing element 110 against one end of the central pack-off sleeve 108. The pack-off sleeve 108, packing elements 110 and pack-off rings 112 can be mounted around the instrumentation lines 50 and be provided with axial bores through which the instrumentation lines 50 can be received. In some implementations, the pack-off sleeve 108, packing elements 110 and pack-off rings 112 can be housed in a pack-off body 114 having a distal end connected to the proximal end of the crossover channel 74 and a proximal end to which a pack-off nut 116 can be threadedly connected. When tightened, the pack-off nut 116 compresses and retains in a fixed position the pack-off sleeve 108, packing elements 110 and pack-off rings 112, thereby increasing the sealing force.

In some implementations, the pack-off sleeve 108, packing elements 110, pack-off rings 112 and pack-off nut 116 are all split components. As a result, these components can all be mounted around and pulled apart from the instrumentation lines 50 in a radial direction, that is, without having to be slid off of the proximal end of the instrumentation lines 50, thereby facilitating assembly and disassembly of the sealing assembly 78. In this regard, it is to be noted that the number, shape, and method of mounting the sealing components included in the sealing assembly 78 can be varied while still providing a hermetic seal along the crossover channel 74.

Referring still to FIG. 11, the pack-off sleeve 108, rings 112, body 114 and nut 116 can be made of a metallic material, such as stainless steel. The packing elements 110, which are the components of the sealing assembly 78 that create the seal around the outer surface of the instrumentation lines 50 can be made from a compressible material, such as a rubber, polymer, elastomer and/or thermoplastic material. Examples of such materials include elastomers such as nitrile rubber (NRB) and hydrogenated nitrile rubber (HNBR), and thermoplastic materials such as Polytetrafluoroethylene (PTFE). The type of material that is used for the packing elements will depend on various factors, such as the downhole operating temperatures, and the exposure to produced or injected fluids and gases. For example, in some implementations, nitrile-based rubber can be used when the transition device is located at surface, as nitrile is more flexible and can achieve a superior seal while pumping the instrumentation lines down the guide string, and be replaced by PTFE when the transition device is deployed downhole, as PTFE can better withstand elevated downhole temperature conditions. In particular, in implementations involving CSS or ISC wells, graphoil or high-temperature-resistant elastomers can be used for the packing elements to withstand the higher temperature often found in these types of wells.

Pumping of the Instrumentation Lines Down the Guide String (208)

Figure 9F:
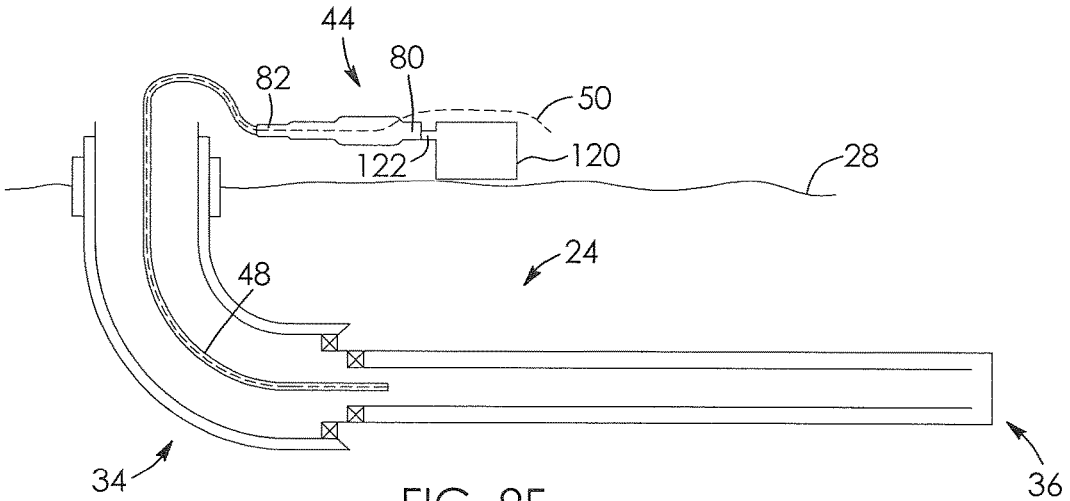
Figure 12:
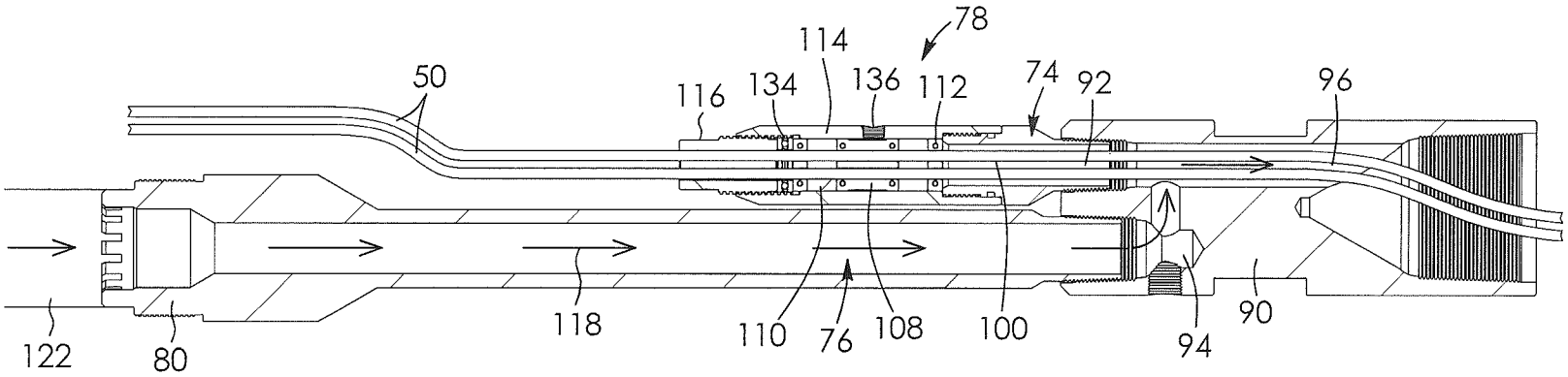
FIG. 12 is a side cross-sectional view schematic of part of a transition device with a canister portion removed.

Referring to FIGS. 9F and 12, once the crossover channel 74 has been sealed by the sealing assembly 78, the instrumentation lines 50 can be pumped down the guide string 48. This step can involve providing, via the fluid channel 76, a pressurized fluid 118, such as pressurized water, into the crossover channel 74 in order to propel the instrumentation lines 50 forward inside the guide string 48. The pressurized fluid 118 can be supplied by a deployment pump 120 located at the surface, such as a rig pump or pump truck, and fluidly connected to the fluid channel 76 via a pump line 122 connected at the proximal end 80 of the transition device 44. The pressurized fluid 118 is pumped into the guide string 48 until the required length of the instrumentation lines 50 has been deployed into the guide string 48. Returning briefly to FIG. 11, in some implementations, it can be desirable or necessary to ensure that the seal provided by the sealing assembly 78 remains effective throughout the pumping operation, which can involve continuously or intermittently monitoring the tightening of the pack-off nut 116 on the pack-off body 114.

Figure 13:
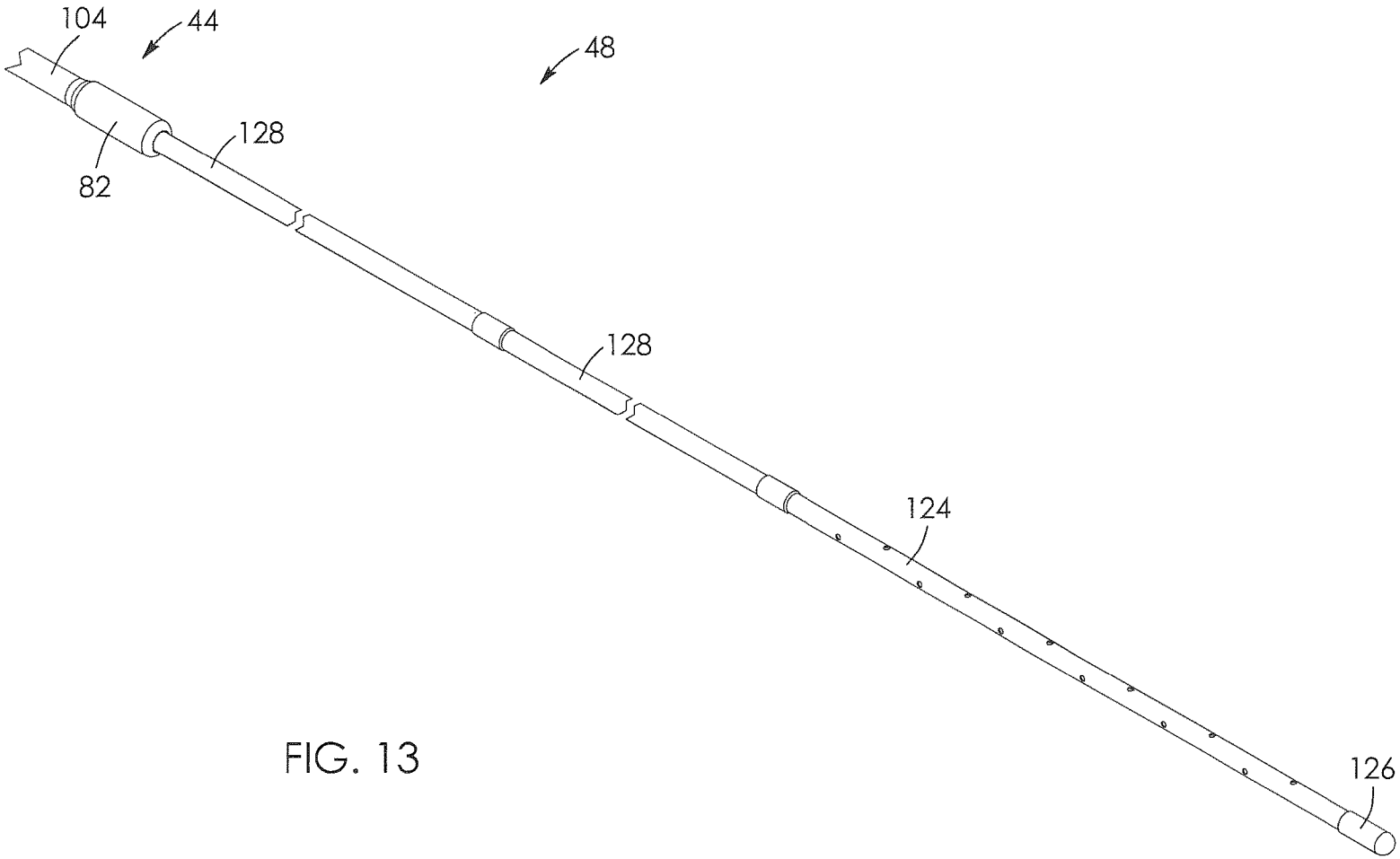
FIG. 13 is a perspective view schematic of a guide string connected to a transition device.

Referring to FIG. 13, in some implementations, the guide string 48 can include a perforated segment 124 having a closed forward extremity 126, which can be referred to as a "bull nose", and a plurality of non-perforated segments 128 serially connected between the distal end 82 of the transition device 44 and the perforated segment 124 (only two of such non-perforated segments 128 are shown in FIG. 13). The peripheral perforations at the distal end of the guide string 48 provide release paths for the pressurized fluid that is used for pumping the instrumentation lines down the guide string 48, while the bull nose 126 provides an abutting surface that prevents the instrumentation lines from being pushed too far and beyond the guide string 48 under the action of the pressurized fluid.

Figure 14:
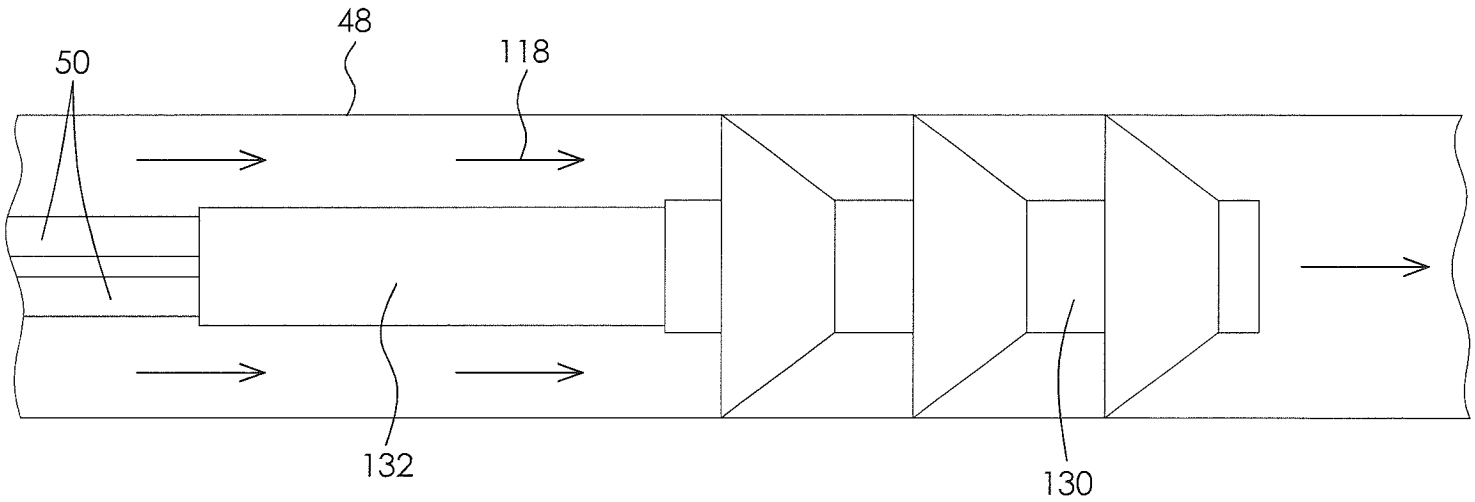
FIG. 14 is a side cross-sectional view schematic of instrumentation lines being pumped down a guide string.

Referring briefly to FIG. 14, in some implementations, a pump down plug or pig 130 is connected to the distal end of the instrumentation lines 50. The pump down plug 130 is sized and shaped to pull the instrumentations forward within the guide string 48 under the propelling force exerted by the pressurized fluid 118, thereby facilitating the instrumentation deployment. In addition, in scenarios where a pair of instrumentation lines 50 is provided to achieve dual-ended fiber-optic-based distributed sensing, a turnaround sub or U-tube 132 can be provided that connects the distal ends of the two instrumentation lines 50 and that allows a same fiber optic sensing cable(s) to be deployed inside one or both instrumentation lines 50 after the installation of the instrumentation lines 50 and downhole pump is complete.

Turning back to FIG. 11, in some implementations, the sealing assembly 78 includes a thrust bearing 134 positioned between the pack-off nut 116 and one of the pack-off rings 112. The thrust bearing 134 can ensure or contribute to ensuring that the seal around the instrumentation lines 50 remains hermetic while the instrument lines 50 are pumped down the guide string 48. For example, the thrust bearing 134 can ensure that tightening the pack-off nut 116 can communicate sufficient compression force to the packing elements 110 to provide a hermetic seal while running the instrumentation lines 50 through the sealing assembly 78. The thrust bearing 134 can also reduce or prevent unwanted rotation of the packing elements 110 and/or instrumentation lines 50, which would otherwise increase friction and prevent or impede the deployment of the instrumentation lines 50 into the guide string 48.

Referring to FIGS. 4 to 6, a number of additional steps can be performed after deploying the instrumentation lines down the guide string, including one or more of the following:

- Replacement of the packing elements 110 with high-temperature-resistant packing elements 110 capable of withstanding downhole temperature conditions in preparation of deploying the production assembly in wellbore;
- Assessment of the integrity of the seal around the instrumentation lines 50 via a pressure-test port 136 provided on the pack-off body 114;
- Disconnection of the deployment pump and sealing of the fluid channel 74, for example using a valve threaded to the proximal end 80 of the transition device 44; and/or
- Installation of the casing portion 86 of the transition device 44 to protect the internal parts of the transition device 44 from damage for when the transition device 44 is deployed downhole.

Connection of the Downhole Pump to the Transition Device (210)

Figure 9G:
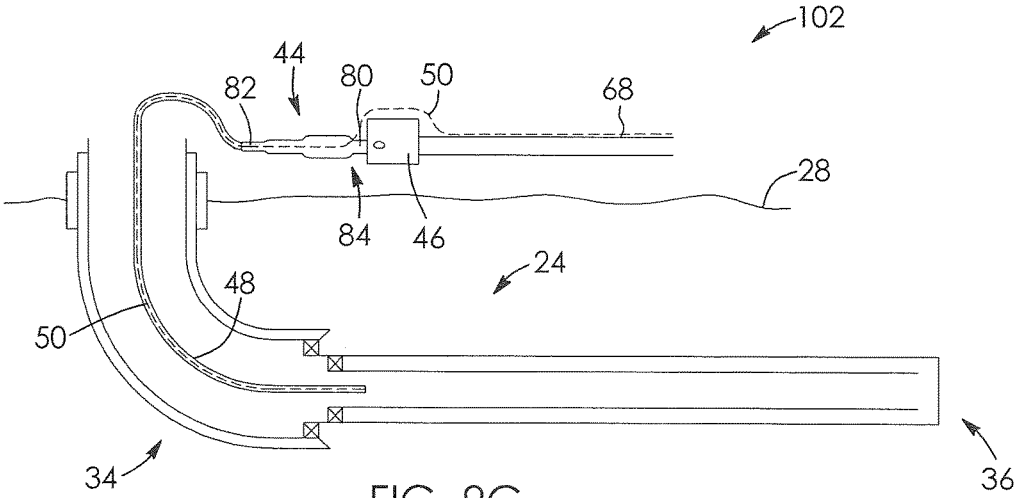
Figure 15A:
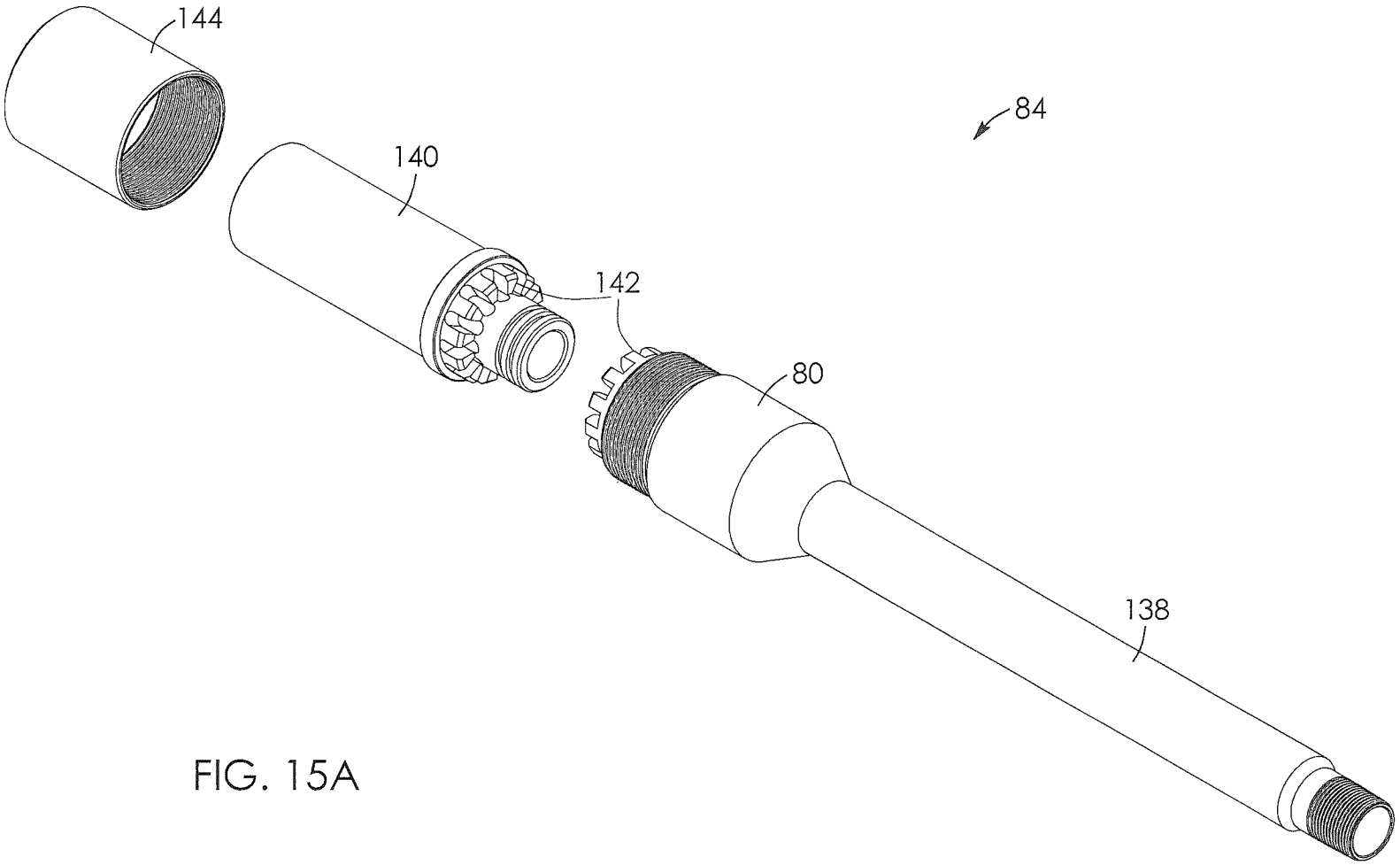
FIGS. 15A and 15B are respectively a perspective view schematic and a side cross-sectional view schematic of a quick connect coupling.
Figure 15B:
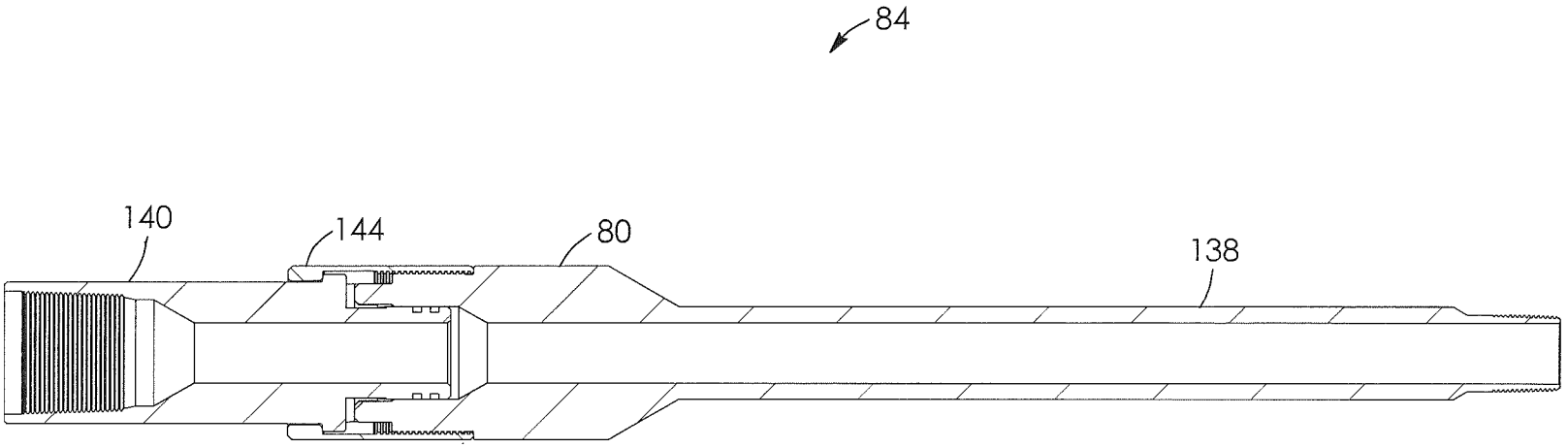

Referring to FIGS. 9G, 15A and 15B, once the instrumentation lines 50 have been deployed, the proximal end 80 of the transition device 44 can be disconnected from the deployment pump and be connected to the downhole pump 46. In some implementations, the connection between the downhole pump 46 and the transition device 44 can be established by means of a quick connect coupling 84. The quick connect coupling 84 can include a lower member 138, which corresponds to the tubular section defining the fluid channel and whose end coincides with the proximal end 80 of the transition device 44, and an upper member 140 connectable to the bottom section of the downhole pump 46.

The lower member 138 and the upper member 140 can include complementary sets of interlocking teeth 142 configured for mating engagement, so as to enable control over the relative orientation between the transition device 44 and the downhole pump 46 upon connection. Such a control can be advantageous in implementations where it is desirable or required that the instrumentation lines 50 exiting the transition device 44 and the pump cable already provided on the downhole pump 46 be clamped onto different sides of the downhole pump 46.

The quick connect coupling 84 can also include a retaining member 144, which can be slid over the mated interlocking teeth 142 to form a joint which prevents relative movement and disconnection of the interlocked lower and upper members 138 and 140 in the axial direction. In some implementations, the quick connect coupling 84 can also seal the fluid channel of transition device 44 upon connecting the transition device 44 and downhole pump 46. Alternatively, other means could be employed to seal the fluid channel.

Deployment of the Production Assembly within the Well (212)

Figure 9H:
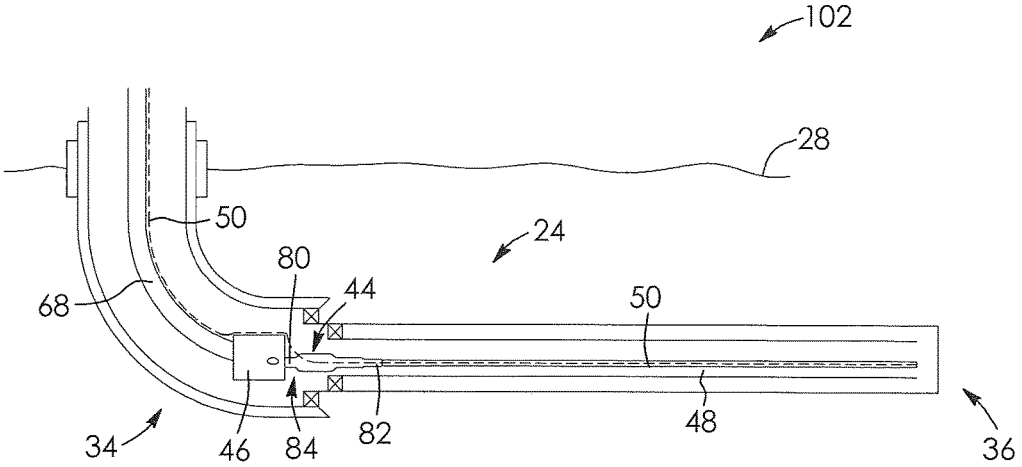

Referring to FIG. 9H, once the transition device 44 has been connected to the downhole pump 46, the portion of the instrumentation lines 50 upstream of the transition device 44 can be clamped onto the exterior of the downhole pump 46 and the pump production line 68, while the production assembly 102 is deployed into the well 24. Therefore, once the production assembly 102 has been deployed into the wellbore, the instrumentation lines 50 can extend from the surface 28 downward along the outside of the pump production line 68, be clamped onto the exterior of the pump 46, cross inside the transition device 44, and run down within the guide string 48 to the toe 36 of the well 24. Depending on the given application, the downhole pump can be located at various locations along the wellbore, for example near the heel 34 of the well 24.

Pump Removal Implementations

As mentioned above, according to the techniques described herein, by sealing the instrumentation lines in the transition device, the instrumentation lines can be decoupled from the downhole pump. The decoupling of the pump and instrumentation lines can enable the pump to be removed from the well for inspection, maintenance or replacement without having to pull the instrumentation lines out of the guide string. This can be advantageous when considering that downhole pumps typically require inspection, maintenance or replacement before the instrumentation, and that pulling the instrumentation out of the guide string with unnecessary frequency can subject the instrumentation to risk of damage, which is best reduced or avoided.

Figure 16:
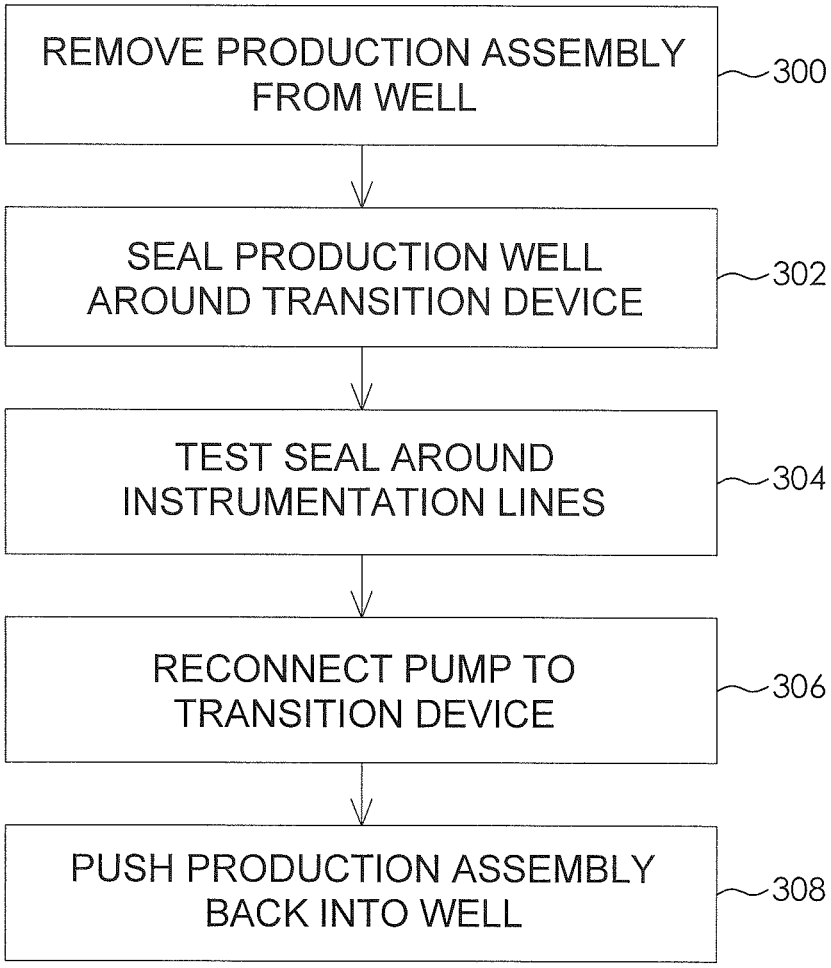
FIG. 16 is a process flow diagram of a method for upkeeping a downhole pump.

With reference to FIG. 16, a method of removing the downhole pump from the production well for inspection, maintenance or replacement can include several steps that will be explained in further detail below. It is to be noted that in some implementations some of the steps could be performed in a different order than described herein.

Removal of the Production Assembly from the Well (300)

Figure 17A:
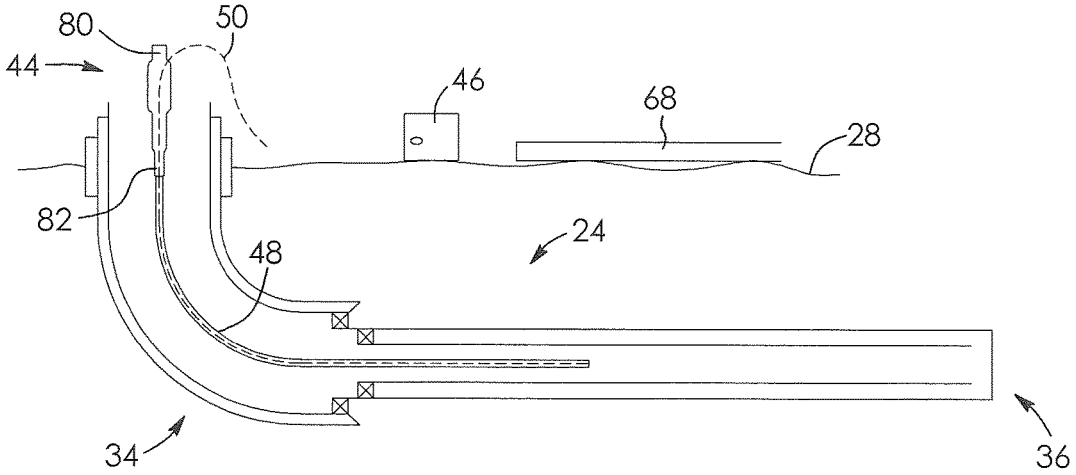
FIGS. 17A to 17D illustrate steps of a method for upkeeping a downhole pump.

Referring to FIG. 17A, the initial step involves pulling back the production assembly 102 from the production well 24 to bring the downhole pump 46 and transition device 44 to the surface 28 while the guide string 48 remains within the well 24.

Sealing of the Production Well Around the Transition Device (302)

Figure 17B:
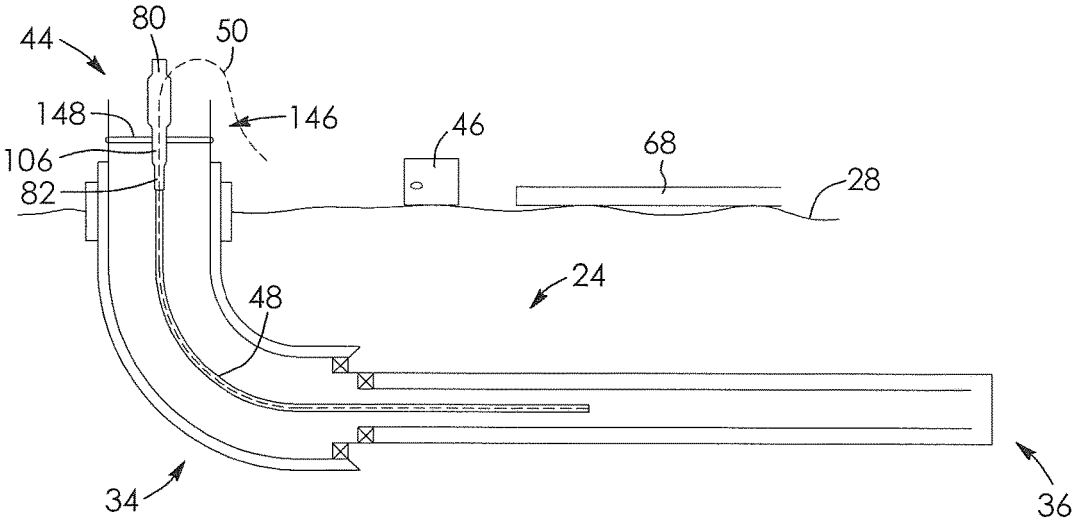

Referring to FIG. 17B, once the downhole pump 46 and transition device 44 has been removed from the well 24, the transition device 44 can be positioned partly inside a well blowout preventer 146, such as a ram blowout preventer or an annulus blowout preventer, or another similar apparatus. Then, the wellbore can be sealed around the outer surface of the transition device 44 by means of the blowout preventer 146. In this regard, and as mentioned above, the transition device 44 can include an upper pup joint 106 that is sized and configured to provide a surface against which the packing unit 148 of the blowout preventer 146 can be press-fitted to seal the annulus between the outer surface of the upper pup joint 106 and the inner surface of the wellbore in order to ensure well fluid containment when the pump 46 is pulled to the surface for inspection, maintenance or replacement.

Testing of the Integrity of the Seal Around the Instrumentation Lines (304)

The integrity of the seal around the instrumentation lines 50 can be verified by using a pressure-test port provided on the sealing assembly. In the event the pressure test is not successful, the packing elements of the sealing assembly can be removed for inspection, maintenance or replacement. Then, once the seal around the instrumentation lines 50 is confirmed, the fluid pathways through and around the transition device 44 sitting at the wellhead are both hermetically sealed, the well 24 is secured against accidental blowout while the pump 46 is sitting at the surface 28.

Reconnection of the Pump to the Transition Device (306)

Figure 17C:
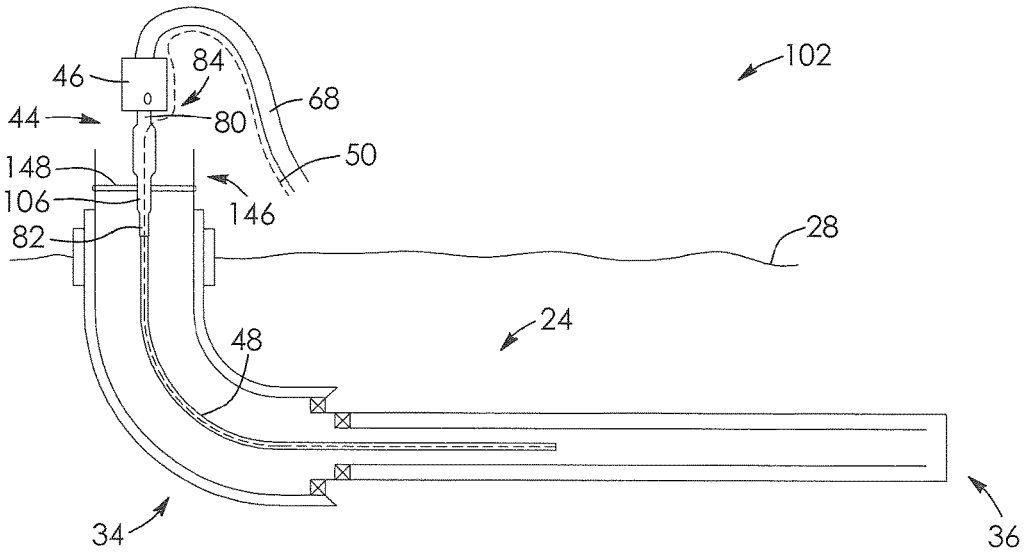

Referring to FIG. 17C, once the downhole pump 46 has been inspected or maintained, the pump 46 can be reconnected to the transition device 44, as explained further above. Alternatively, in the event the pump 46 needed replacement, a replacement downhole pump 46 can be connected to the transition device 44 in replacement of the previous downhole pump.

Redeployment of the Production Assembly Back into the Production Well (308)

Figure 17D:
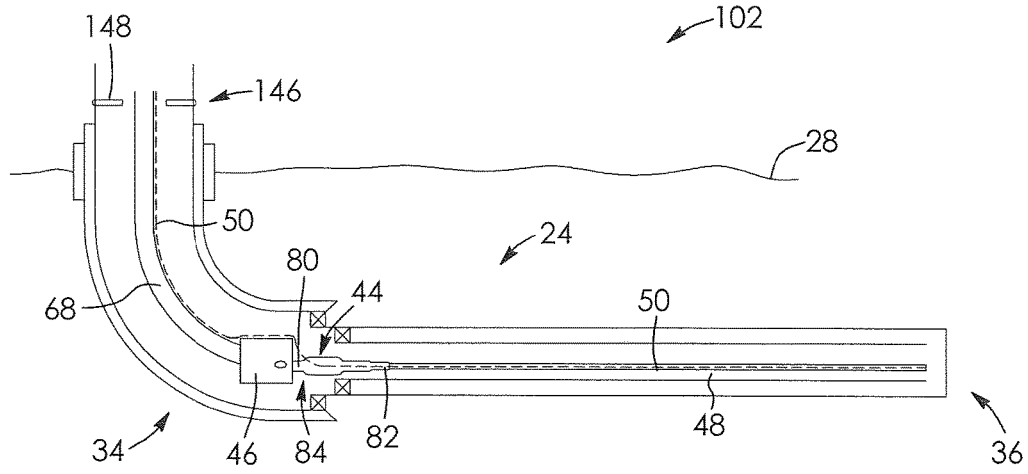

Referring to FIG. 17D, once the inspection, maintenance or replacement of the downhole pump has been completed, the packing unit 148 of the blowout preventer 146 can be activated in an open position to release the transition device 44. Then, the production assembly 102 can be deployed into the wellbore.

Various modifications can be made to the disclosed implementations and still be within the scope of the following claims.

The invention claimed is:

1. An assembly for use in hydrocarbon recovery operations along a well, comprising:

a downhole tool deployed into the well;

a guide string deployed into the well ahead of the downhole tool;

at least one instrumentation line deployed into the well inside the guide string;

a transition device serially connected between the downhole tool and the guide string, comprising a housing and a crossover channel extending through the housing and having a proximal end and a distal end, the crossover channel providing a crossover path for the at least one instrumentation line between an exterior of the transition device at the proximal end and an interior of the guide string at the distal end; and a fluid channel extending through the housing radially offset from the crossover channel, wherein the fluid channel is sealed against fluid flow therein during a production mode, and wherein the fluid channel is fluidly connected to the crossover channel during a deployment mode to supply a pressurized fluid into the crossover channel so as to propel the at least one instrumentation line forward inside the guide string.

2. The assembly according to claim 1, further comprising a sealing assembly configured to seal the crossover channel around the at least one instrumentation line.

3. The assembly according to claim 1, wherein the at least one instrumentation line comprises a plug at a forward end thereof sized and shaped to propel, during the deployment mode, the at least one instrumentation line forward within the guide string under action of the pressurized fluid.

4. The assembly according to claim 1, wherein the transition device comprises a quick connect coupling provided at a proximal end thereof for connection to the downhole tool.

5. The assembly according to claim 4, wherein the quick connect coupling comprises a lower member defining the proximal end of the transition device and an upper member connected to the downhole tool, the lower member and the upper member configured for mating engagement so as to enable control over a relative orientation of the transition device and the downhole tool upon connection therebetween.

6. The assembly according to claim 1, wherein the transition device comprises:

a canister portion housing parallel tubular sections defining the crossover channel and the fluid channel, and a Y-branch body having a crossover channel input, a fluid channel input and a guide string output; and a pup joint assembly providing a path for the at least one instrumentation line between the guide string output of the Y-branch body and the guide string.

7. The assembly according to claim 1, wherein the downhole tool, the guide string and the transition device are provided in a substantially coaxial arrangement with respect to one another.

8. The assembly according to claim 1, wherein the downhole tool is an electrical submersible pump (ESP).

9. The assembly according to claim 1, wherein the at least one instrumentation line is configured to remain in place upon removal of the downhole tool from the production well for maintenance, inspection or replacement.

10. The assembly according to claim 1, wherein the at least one instrumentation line comprises a plurality of fiber-optic temperature sensors.

11. A transition device for use with a downhole pump employed for in situ hydrocarbon recovery operations along a production well and with a guide string insertable into the production well ahead of the downhole pump, comprising:

a housing having a proximal end connectable to the downhole pump and a distal end connectable to the guide string;

a quick connect coupling provided at the proximal end of the housing for connection to the downhole pump;

a crossover channel extending through the housing and providing a crossover path for at least one instrumentation line between an exterior of the transition device at the proximal end and an interior of the guide string at the distal end;

a sealing assembly comprising a plurality of high-temperature-resistant packing elements sized and shaped to seal the crossover channel around the at least one instrumentation line; and a fluid channel extending through the housing radially offset from the crossover channel, wherein the fluid channel is sealed against fluid flow therein during a production mode, and wherein the fluid channel is in fluid communication with the crossover channel during a deployment mode to provide a pressurized fluid into the crossover channel in order to propel the at least one instrumentation line forward inside the guide string.

12. The transition device according to claim 11, wherein the quick connect coupling comprises a lower member defining the proximal end of the housing and an upper member connectable to the downhole pump, the lower member and the upper member being configured for mating engagement so as to enable control over a relative orientation of the transition device and the downhole pump upon connection therebetween.

13. The transition device according to claim 12, wherein the quick connect coupling further comprises a retaining member preventing relative axial movement and disconnection of the lower and upper members.

14. The transition device according to claim 11, further comprising, from the proximal end to the distal end of the housing:

a canister portion housing parallel tubular sections defining the crossover channel and the fluid channel, and a Y-branch body having a crossover channel input, a fluid channel input and a guide string output; and a pup joint assembly providing a path for the at least one instrumentation line between the guide string output of the Y-branch body and the guide string.

15. A transition device for use with a downhole tool employed in hydrocarbon recovery operations along a well and with a guide string insertable into the well ahead of the downhole tool, comprising:

a housing serially connectable between the downhole tool and the guide string;

a sealable crossover channel extending through the housing and having a proximal end and a distal end, the crossover channel providing a crossover path for at least one instrumentation line between an exterior of the transition device at the proximal end and an interior of the guide string at the distal end; and a fluid channel extending through the housing radially offset from the crossover channel, wherein the fluid channel is sealed against fluid flow therein during a production mode, and wherein the fluid channel is in fluid communication with the crossover channel during a deployment mode to provide a pressurized fluid into the crossover channel in order to propel the at least one instrumentation line forward inside the guide string.

16. The transition device according to claim 15, further comprising a sealing assembly configured to seal the crossover channel around the at least one instrumentation line.

17. The transition device according to claim 15, further comprising a quick connect coupling provided at a proximal end thereof for connection to the downhole tool.

18. The transition device according to claim 17, wherein the quick connect coupling comprises a lower member defining the proximal end of the transition device and an upper member connectable to the downhole tool, the lower member and the upper member being configured for mating engagement so as to enable control over a relative orientation of the transition device and the downhole tool upon connection therebetween.

19. The transition device according to claim 15, further comprising:

a canister portion housing parallel tubular sections defining the crossover channel and the fluid channel, and a Y-branch body having a crossover channel input, a fluid channel input and a guide string output; and a pup joint assembly providing a path for the at least one instrumentation line between the guide string output of the Y-branch body and the guide string.

* * * * *